US010173429B2

(12) United States Patent
Nawano et al.

(10) Patent No.: US 10,173,429 B2
(45) Date of Patent: Jan. 8, 2019

(54) LIQUID EJECTING HEAD, METHOD FOR MANUFACTURING THE SAME, AND LIQUID EJECTING APPARATUS

(71) Applicant: SEIKO EPSON CORPORATION, Tokyo (JP)

(72) Inventors: Masahisa Nawano, Suwa (JP); Taiki Hanagami, Matsumoto (JP); Isamu Togashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 16 days.

(21) Appl. No.: 15/296,523

(22) Filed: Oct. 18, 2016

(65) Prior Publication Data

US 2017/0120599 A1 May 4, 2017

(30) Foreign Application Priority Data

Oct. 30, 2015 (JP) ..... 2015-214959

(51) Int. Cl.
*B41J 2/165* (2006.01)
*B41J 2/16* (2006.01)

(52) U.S. Cl.
CPC ..... *B41J 2/16535* (2013.01); *B41J 2/162* (2013.01); *B41J 2/1623* (2013.01)

(58) Field of Classification Search
CPC ..... B41J 2/16535; B41J 2/162; B41J 2/1623; B41J 2/1621; B41J 2/1655; B41J 2202/19; B41J 2202/20; B41J 2202/21
See application file for complete search history.

(56) References Cited

U.S. PATENT DOCUMENTS

2013/0241998 A1* 9/2013 Ohno ..... B41J 2/155 347/44

FOREIGN PATENT DOCUMENTS

| | | | |
|---|---|---|---|
| JP | 2005-028391 A | | 2/2005 |
| JP | 2011-079272 A | | 4/2011 |
| JP | 2011079272 A | * | 4/2011 |
| JP | 2012-060717 A | | 3/2012 |
| JP | 2013-184470 A | | 9/2013 |
| JP | 2013-193265 A | | 9/2013 |

* cited by examiner

*Primary Examiner* — Henok Legesse
(74) *Attorney, Agent, or Firm* — Workman Nydegger

(57) ABSTRACT

A liquid ejecting head includes a head body which has a nozzle opening for ejecting a liquid and a first wiping surface to be wiped by a wiper; and a target wiping member which has a second wiping surface to be wiped by the wiper, wherein the head body and the target wiping member are lined up via a gap so as to face in the same direction as the first wiping surface and the second wiping surface, and an elastic member is elastic deformed and held in the gap to block the gap on a side of the first and second wiping surface.

15 Claims, 20 Drawing Sheets

LIQUID EJECTING HEAD, METHOD FOR MANUFACTURING THE SAME, AND LIQUID EJECTING APPARATUS

BACKGROUND

1. Technical Field

The present invention relates to a liquid ejecting head which ejects a liquid from a nozzle opening, a method for manufacturing the same, and a liquid ejecting apparatus which is equipped with a liquid ejecting head; and particularly relates to an ink jet recording head which discharges ink as a liquid, a method for manufacturing the same, and an ink jet recording apparatus.

2. Related Art

An ink jet recording head which is an example of a liquid ejecting head is equipped with a fixing board such as a cover head which is provided on a liquid ejecting surface side, a head body which is laminated in a direction which is orthogonal to the liquid ejecting surface, and a holding member which is adhered to the opposite side to the liquid ejecting surface of the head body. The liquid ejecting head is wiped to remove liquids or foreign matter attached to wiping surfaces such as a liquid ejecting surface.

With such liquid ejecting heads, increasing the concentration, the length, or the like of the nozzle openings in a single head body is difficult since the yield of the head body is decreased and the manufacturing cost is high. For this reason, a liquid ejecting head where a plurality of head bodies is fixed and modularized (the components are integrated) in a common holder has been proposed.

However, there is a problem in that, when ink is held in a gap between adjacent head bodies, a gap between a head body and the holder which holds the head body, or the like, the held ink drops onto the target ejecting medium at an unexpected timing and contaminates the target ejecting medium.

For this reason, ink jet recording heads where the intervals of the gaps are adjusted or in which gaps are filled with an adhesive agent or the like have been proposed (for example, refer to JP-A-2013-184470 and JP-A-2011-079272).

However, there is a problem in that, even when the gaps are adjusted, there is a concern that ink will drop onto the target ejecting medium at an unexpected timing due to the ink's own weight and cause contamination.

In addition, when an adhesive agent is present in a gap in a wiping surface, there is a problem in that the ink will erode the adhesive agent and some of the adhesive agent will come off and become foreign matter, or in that some of the adhesive agent will comes off and become foreign matter due to the wiper coming into contact with the adhesive agent. The foreign matter may drop onto the target ejecting medium and cause contamination, or liquid droplet discharge failures may be caused by the wiper imprinting the foreign matter into nozzle openings.

Here, these problem are present not only in ink jet recording heads, but also in liquid ejecting heads which eject liquids other than ink in the same manner.

SUMMARY

An advantage of some aspects of the invention is to provide a liquid ejecting head which suppresses the generation of foreign matter by suppressing contamination of a target ejecting medium, a method for manufacturing the same, and a liquid ejecting apparatus.

According to an aspect of the invention, there is provided a liquid ejecting head including a head body which has a nozzle opening which ejects a liquid and a first wiping surface which is wiped by a wiper, and a target wiping member which has a second wiping surface which is wiped by the wiper, in which the head body and the target wiping member are lined up via a gap such that the first wiping surface and the second wiping surface face in the same direction, and an elastic member which blocks openings on the first wiping surface side and the second wiping surface side is held in the gap in a state of elastic deformation.

In this aspect, it is possible to suppress a liquid or foreign matter from entering a gap by blocking an opening on the wiping surface side in a gap between a head body and a target wiping member with the elastic member. In addition, even when the wiper comes into contact with the elastic member when wiping the wiping surface with a wiper, some of the elastic member does not easily come off and foreign matter is not easily generated in comparison with the wiper coming into contact with an adhesive agent.

Here, it is preferable to include a plurality of the head bodies and for the target wiping member to be the head bodies. Due to this, it is possible to increase the number of rows or lengthen the nozzle openings using the plurality of head bodies. In addition, it is possible to suppress a liquid from entering gaps between a plurality of head bodies and to suppress foreign matter from being generated.

It is preferable for the target wiping member to be a holder which holds the head body. Due to this, it is possible to suppress a liquid from entering a gap between a holder and a head body and to suppress foreign matter from being generated.

It is preferable for the first wiping surface and the second wiping surface to be arranged at a position facing a target ejecting medium. Due to this, it is possible to suppress liquid which enters a gap or foreign matter which is generated by contact with a wiper from dropping onto a target ejecting medium and causing contamination of the target ejecting medium.

It is preferable for the first wiping surface and the second wiping surface to be arranged on a side surface in a direction which is orthogonal to an ejecting direction of a liquid. Due to this, it is possible to remove a liquid or foreign matter which is attached to the side surface with the wiper.

It is preferable for the gap to be provided by openings on a side which faces a target ejecting medium and a side surface side in a direction which is orthogonal to the ejecting direction of a liquid, and for the elastic member to block the opening of both of the side which faces the target ejecting medium and the side surface. Due to this, it is possible to reliably suppress a liquid from entering from an opening of a gap.

It is preferable for the elastic member to have a shape following the openings of the gap, and for the elastic member to be in contact with the head body at a smaller area than the side surface which forms the gap of the head body. Due to this, compared to a case where the elastic member comes into contact with the entire surface of the head body, the pressure with which the elastic member presses the head body is reduced and it is possible to suppress positional shifting of the head body.

It is preferable to include a holder which holds the opposite surface side to the first wiping surface of the head body, in which the gap is preferably provided from the first wiping surface of the head body to the surface side which is held by the holder, and the elastic member is preferably provided at a height which reaches a surface which holds the head body of the holder from the opening of the first wiping surface side of the gap. Due to this, the elastic member coming into contact with the holder makes it possible to suppress positional shifting of the elastic member in the gap.

It is preferable for the elastic member to be thinner at an inside of the opening than at the opening side of the gap. Due to this, it is possible to reliably block an opening in the gap using the elastic member, the pressure with which the elastic member presses the head body is reduced, and it is possible to suppress positional shifting of the head body.

It is preferable for a protrusion which protrudes toward the head body to be provided in the elastic member and for the front end of the protrusion to be in contact with the head body. Due to this, the pressure with which the elastic member presses the head body is reduced and it is possible to suppress positional shifting of the head body.

It is preferable for a liquid-repellent film to be formed on the first wiping surface of the head body and for the liquid-repellent film to be removed in a portion which is in contact with the elastic member of the head body. Due to this, the friction resistance of the portion where the elastic member is in contact with the head body is increased and it is possible to suppress positional shifting of the elastic member.

It is preferable for the elastic member and the head body to be adhered using an adhesive agent which is provided in a portion other than the opening of the gap. Due to this, it is possible to suppress positional shifting of the elastic member.

It is preferable for the elastic member to be held in the gap by elastic force without being adhered. Due to this, it is possible to suppress the generation of foreign matter due to liquids coming into contact with the adhesive agent.

According to another aspect of the invention, there is provided a liquid ejecting apparatus which is equipped with the liquid ejecting head of the aspect described above.

In the aspect, it is possible to realize a liquid ejecting apparatus where contamination of a target ejecting medium and generation of foreign matter due to a liquid which enters a gap are suppressed.

According to still another aspect of the invention, there is provided a method for manufacturing a liquid ejecting head which is equipped with a head body which has a nozzle opening which ejects a liquid and a first wiping surface which is wiped by a wiper, and a target wiping member which has a second wiping surface which is wiped by the wiper, the method including lining up the head body and the target wiping member via a gap such that the first wiping surface and the second wiping surface face in the same direction, in which, after stretching and inserting an elastic member in the gap between the head body and the target wiping member, openings on the first wiping surface side and the second wiping surface side are blocked by the elastic member by contracting the elastic member using elastic force.

In this aspect, it is possible to easily provide an elastic member in a gap between a head body and a target wiping member. In addition, since it is easy to attach and detach the elastic member from the gap, it is possible to make attachment and detachment of the head body and the target wiping member easy.

According to still another aspect of the invention, there is provided a method for manufacturing a liquid ejecting head which is equipped with a head body which has a nozzle opening which ejects a liquid and a first wiping surface which is wiped by a wiper, and a target wiping member which has a second wiping surface which is wiped by the wiper, the method including bonding an elastic member to any one of the head body and the wiping member, in which, by lining up the head body and the target wiping member to one of which the elastic member is bonded such that the first wiping surface and the second wiping surface face in the same direction, openings on the first wiping surface side and the second wiping surface side in the gap between the head body and the target wiping member is blocked by the elastic member.

In the aspect, since the elastic member is bonded to a head body, it is possible to easily and precisely align the head body and the elastic member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Detailed description will be given below of the invention based on embodiments.

Embodiment 1

Figure 1:
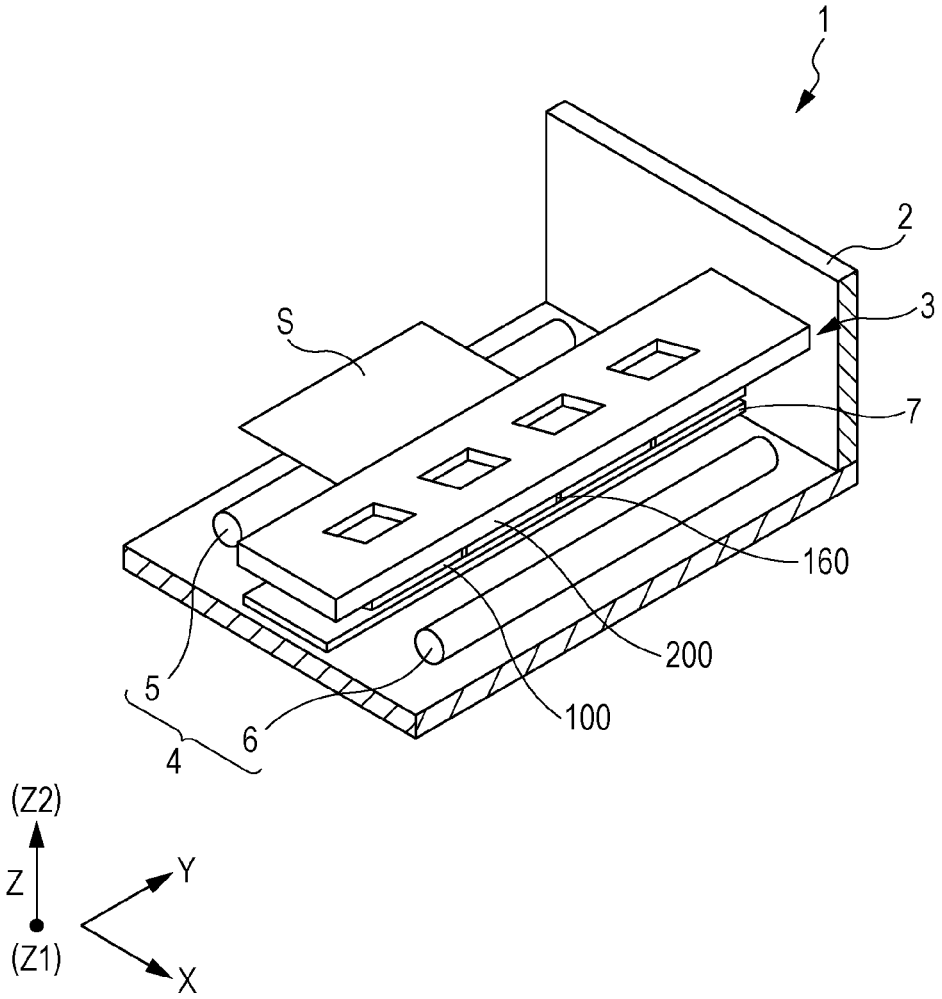
FIG. 1 is a schematic perspective view of a recording apparatus according to embodiment 1 of the invention.

FIG. 1 is a perspective view showing a schematic configuration of an ink jet recording apparatus which is an example of the liquid ejecting apparatus according to embodiment 1 of the invention.

An ink jet recording apparatus which is an example of the liquid ejecting apparatus of the present embodiment is a so-called line type recording apparatus which performs printing by fixing an ink jet recording head which is an example of the liquid ejecting head and transporting a recording sheet such as paper which is a target ejecting medium.

In detail, as shown in FIG. 1, an ink jet recording apparatus 1 is equipped with an apparatus body 2, an ink jet recording head 3 (also simply referred to below as a recording head 3) which is equipped with a plurality of head bodies 100 and fixed to the apparatus body 2, a transport means 4 which transports a recording sheet S, and a supporting member 7 which supports the recording sheet S which faces the recording head 3. Here, in the present embodiment, the transport direction of the recording sheet S is called a first direction X. In addition, a direction which is orthogonal to the first direction X in the in-plane direction in which a nozzle opening of the recording head 3 opens is called a second direction Y. Furthermore, a direction which is orthogonal to the first direction X and the second direction Y is called a third direction Z. In addition, in the in-plane direction which includes the third direction Z, a liquid ejecting direction side (the recording sheet S side with respect to the recording head 3) is called the Z1 side and the opposite side is called the Z2 side.

The recording head 3 is equipped with a plurality of the head bodies 100 and a holder 200 which holds the plurality of the head bodies 100.

The plurality of the head bodies 100 are lined up in a direction which intersects with the first direction X which is a transport direction, the second direction Y which is orthogonal to the first direction X in the present embodiment, and fixed to the holder 200. Here, in the present embodiment, the plurality of the head bodies 100 are lined up in a straight line in the second direction Y. That is, the plurality of the head bodies 100 are not arranged to be shifted in the first direction X. Due to this, it is possible to make the width of the recording head 3 in the first direction narrow and to miniaturize the recording head 3. In addition, the plurality of the head bodies 100 are lined up by distributing gaps 101 between the head bodies 100 which are adjacent to each other.

In addition, the holder 200 holds the plurality of the head bodies 100 such that nozzle openings 21 of the plurality of the head bodies 100 face the recording sheet S side, and is fixed to the apparatus body 2.

The transport means 4 transports the recording sheet S in the first direction X with respect to the recording head 3. The transport means 4 is equipped with, for example, a first transport roller 5 and a second transport roller 6 which are provided on both sides in the first direction X.

The recording sheet S is transported by the first transport roller 5 and the second transport roller 6. Here, the transport means 4 which transports the recording sheet S is not limited to a transport roller and may be a belt, a drum, or the like.

The supporting member 7 supports the recording sheet S which is transported by the transport means 4 at a position facing the recording head 3. The supporting member 7 is formed of, for example, metal, resin, or the like of which a cross-section which is provided facing the recording head 3 between the first transport roller 5 and the second transport roller 6 has a rectangular shape.

Here, an adsorbing means which adsorbs the transported recording sheet S on the supporting member 7 may be provided in the supporting member 7. Examples of the adsorbing means include a means which suctions and adsorbs by suctioning the recording sheet S, a means which electrostatically attracts and adsorbs the recording sheet S by electrostatic force, and the like. For example, in a case where the transport means 4 is a belt or a drum, the supporting member 7 supports the recording sheet S on the belt or the drum at a position which faces the recording head 3.

In addition, although not shown in the diagram, a liquid storing means such as an ink tank or an ink cartridge in which ink is stored is connected to each of the head bodies 100 of the recording head 3 so as to be able to supply ink thereto. The liquid storing means, for example, may be held on the recording head 3 or may also be held at a position which is different from the recording head 3 in the apparatus body 2. In addition, a flow path or the like for supplying ink which is supplied from the liquid storing means to the head body 100 may be provided in the holder 200 or ink from the liquid storing means may be supplied to the head body 100 via a flow path member with the flow path member provided separately from the holder 200. Naturally, ink may be directly supplied from the liquid storing means to the head body 100 without passing the holder 200 or a flow path member or the like which is fixed to the holder 200.

In the ink jet recording apparatus 1 of the present embodiment, the recording sheet S is transported by the first transport roller 5 and printing is carried out on the recording sheet S which is supported on the supporting member 7 by the recording head 3. The printed recording sheet S is transported by the second transport roller 6.

Figure 2:
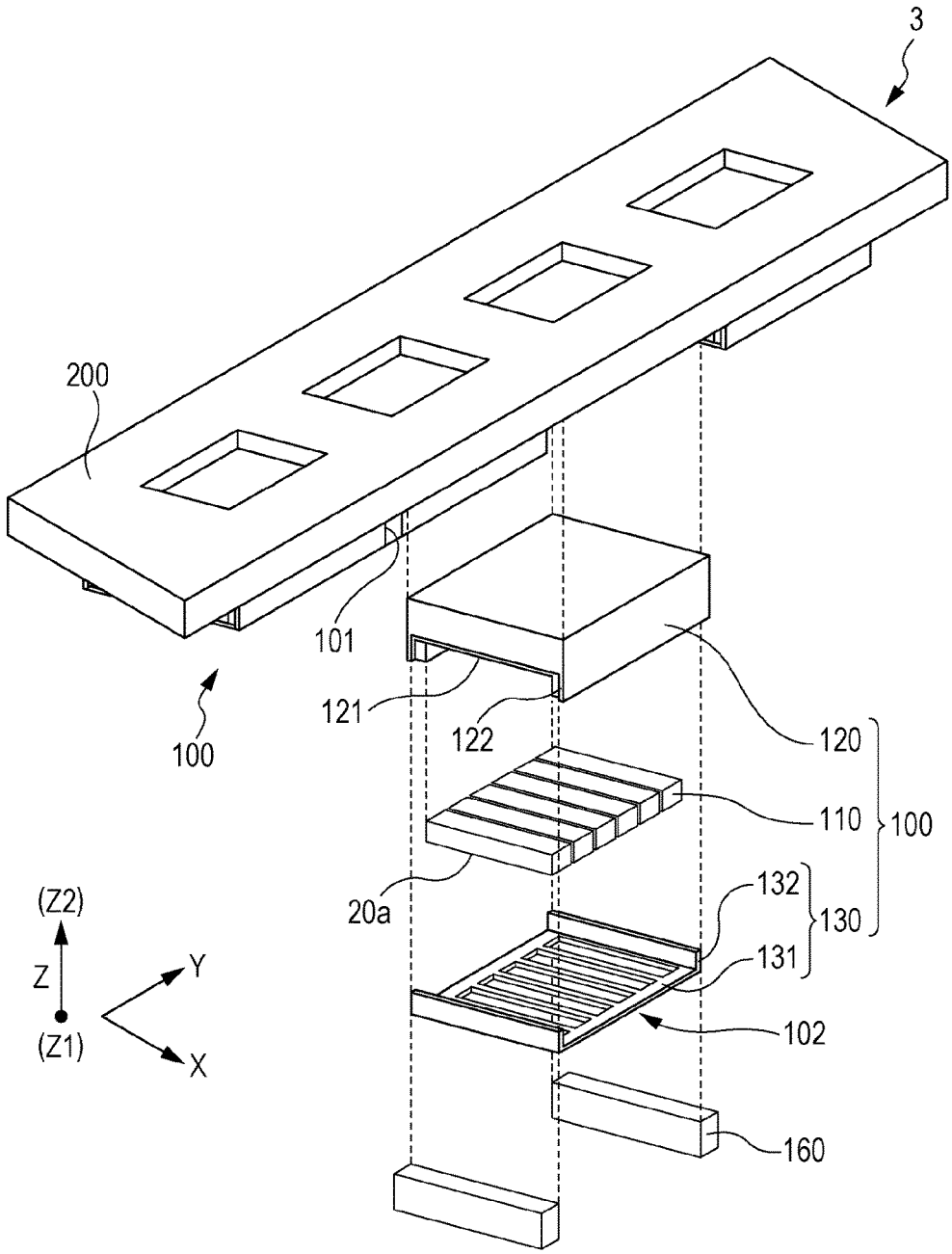
FIG. 2 is a perspective view of a recording head according to embodiment 1 of the invention.
Figure 3:
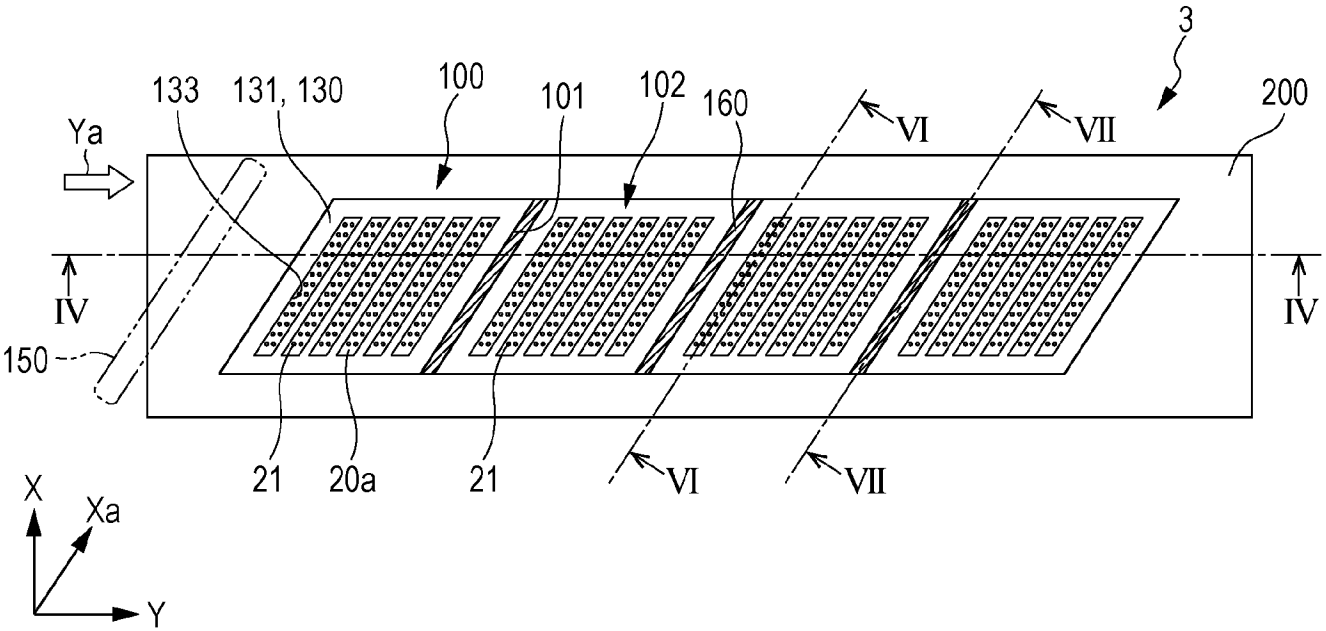
FIG. 3 is a plan view of a recording head according to embodiment 1 of the invention.
Figure 4:
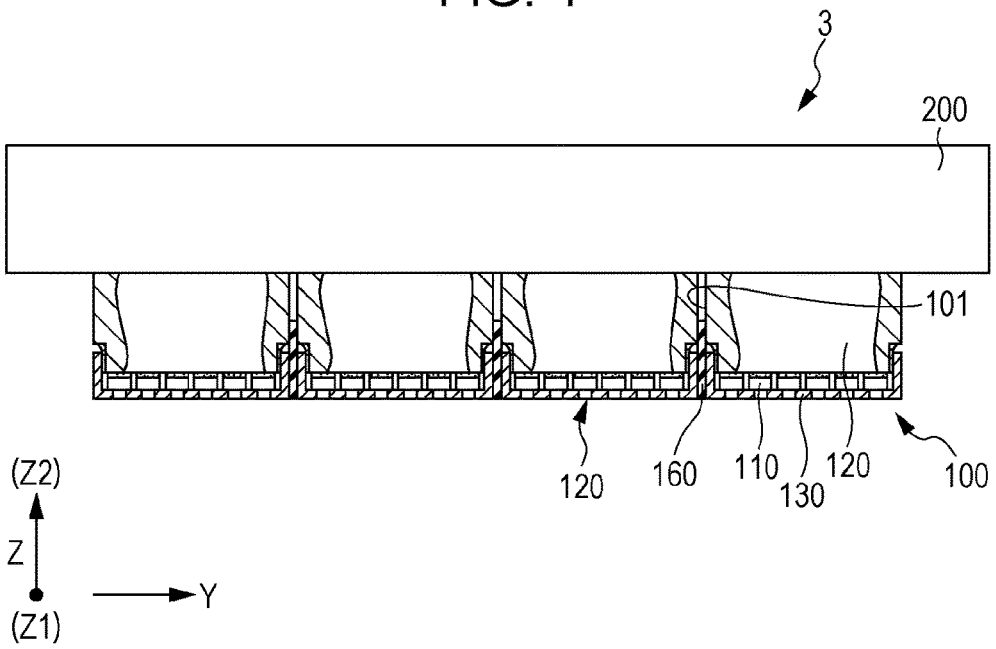
FIG. 4 is a cross-sectional view of a recording head according to embodiment 1 of the invention.
Figure 5:
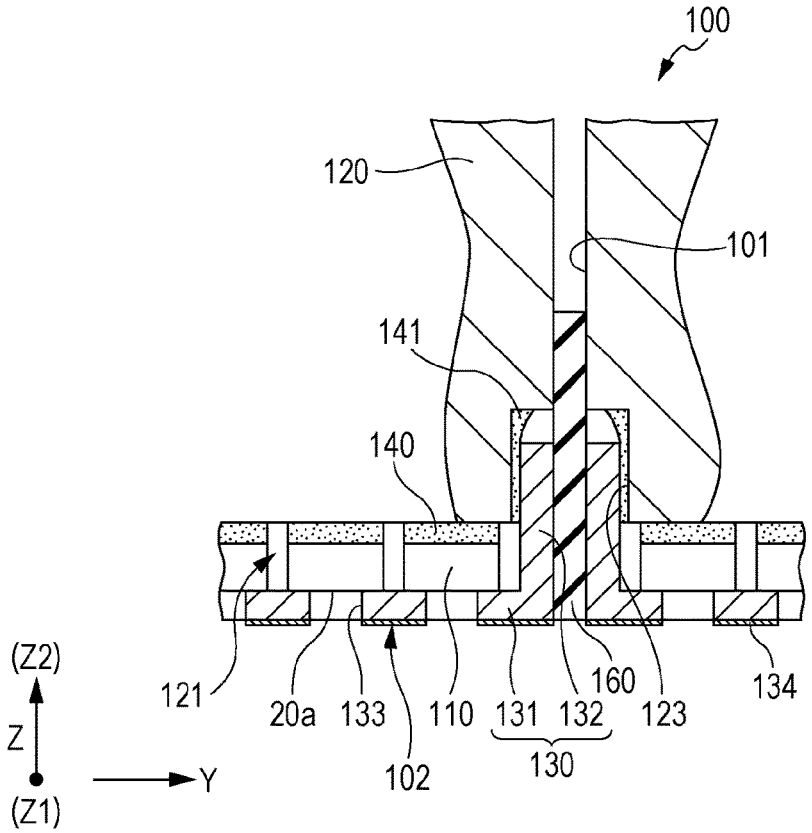
FIG. 5 is an enlarged cross-sectional view of main portions of the recording head according to embodiment 1 of the invention.
Figure 6:
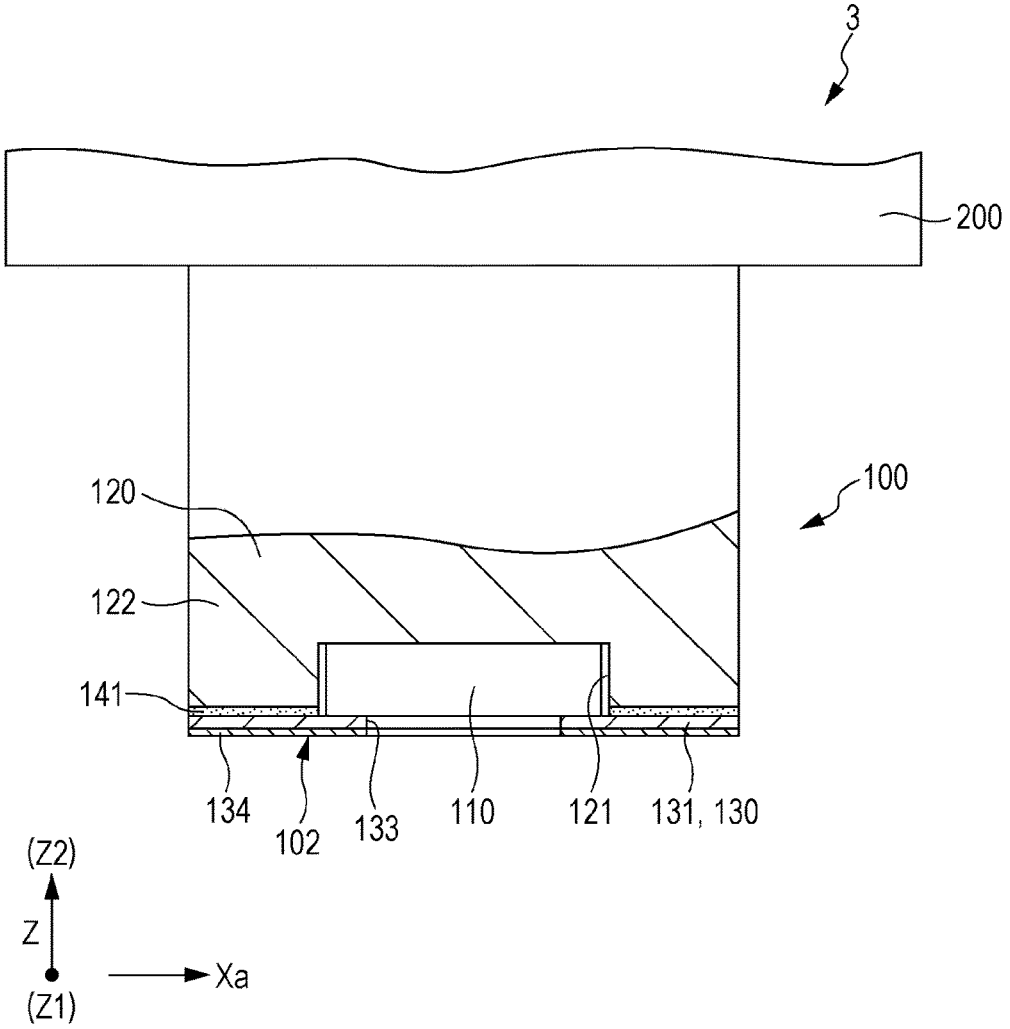
FIG. 6 is a cross-sectional view of the recording head according to embodiment 1 of invention.
Figure 7:
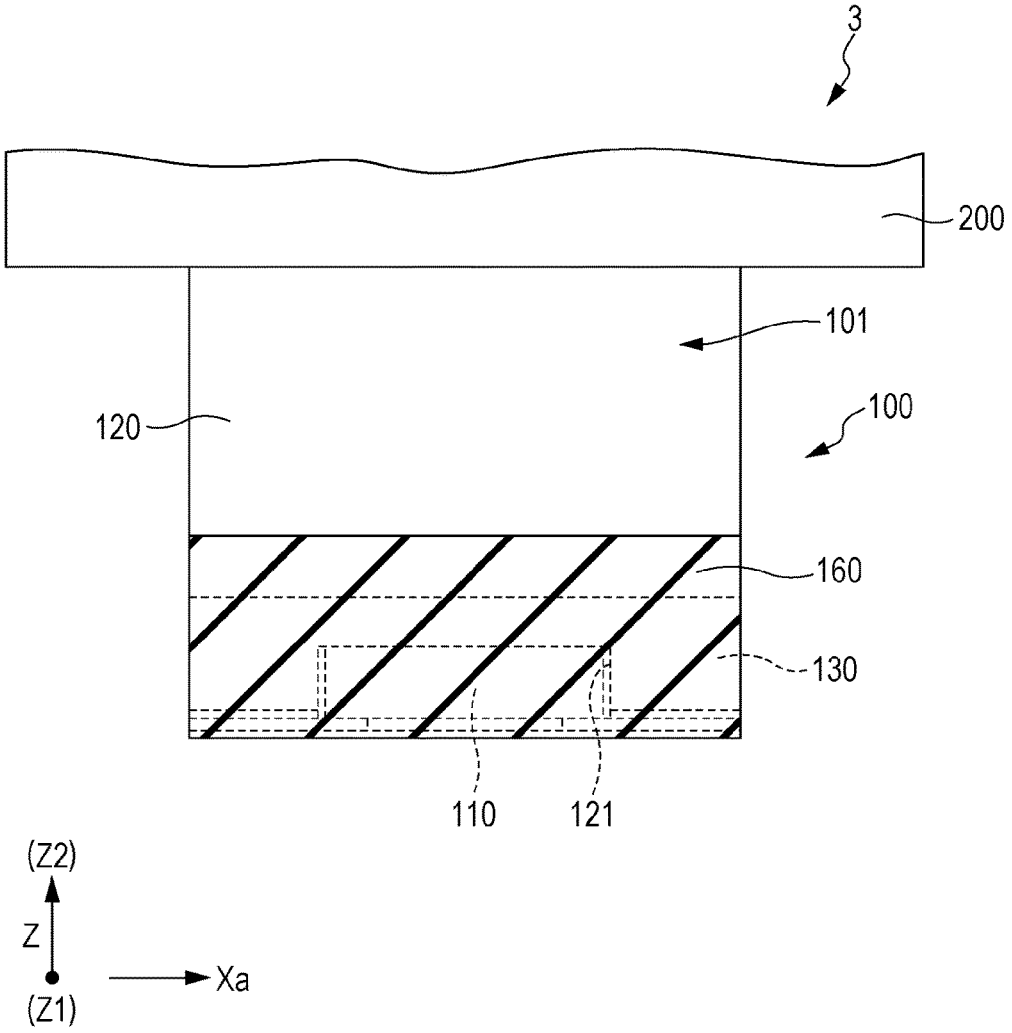
FIG. 7 is a cross-sectional view of the recording head according to embodiment 1 of the invention.

Here, detailed description will be further given of the recording head 3 which is mounted on the ink jet recording apparatus 1 with reference to FIG. 2 to FIG. 7. Here, FIG. 2 is an exploded perspective view showing an ink jet recording head which is an example of the liquid ejecting head according to embodiment 1 of the invention, FIG. 3 is a plan view on the liquid ejecting surface side of the ink jet recording head, FIG. 4 is a cross-sectional view where a main portion is cut out along the IV-IV' line in FIG. 3, FIG. 5 is a diagram where a main portion in FIG. 4 is enlarged, FIG. 6 is a cross-sectional view where a main portion of the VI-VI' line in FIG. 3 is cut out, and FIG. 7 is a cross-sectional view along the VII-VII' line in FIG. 3.

As shown in the diagram, the recording head 3 of the present embodiment is equipped with the plurality of the head bodies 100 and the holder 200 which holds the plurality of the head bodies 100.

The head bodies 100 have a liquid ejecting surface 20*a* on which the nozzle openings 21 are provided on the Z1 side in the third direction Z.

The head bodies 100 are fixed on a surface side which faces the recording sheet S of the holder 200, that is, on the Z1 side which is the recording sheet S side in the third direction Z.

Then, as described above, the plurality of the head bodies 100 are lined up along a straight line in the second direction Y which is orthogonal to the first direction X which is the transport direction and are fixed to the holder 200. That is, the plurality of the head bodies 100 are not arranged to be shifted in the first direction X. Due to this, it is possible to make the width of the recording head 3 in the first direction X narrow and miniaturize the recording head 3. Naturally, the head bodies 100 which are lined up in the second direction Y may be arranged to be shifted in the first direction X; however, when the head bodies 100 are greatly shifted in the first direction X, the width of the holder 200 or the like in the first direction X is increased. When the size of the recording head 3 in the first direction X is large, the distance between the first transport roller 5 and the second transport roller 6 in the ink jet recording apparatus 1 in the first direction X is great, and it is difficult to fix the posture of the recording sheet S. In addition, the recording head 3 and the ink jet recording apparatus 1 become large.

Here, in the present embodiment, four of the head bodies 100 are fixed to the holder 200; however, the number of the head bodies 100 is not particularly limited thereto as long as are two or more.

In addition, in the present embodiment, the plurality of the head bodies 100 are lined up by distributing gaps 101 between the head bodies 100 which are adjacent to each other.

Here, detailed description will be further given of an example of the head body 100 which is mounted on the recording head 3.

As shown in the diagram, the head body 100 is equipped with a plurality of head chips 110, a holding member 120 which holds a plurality of the head chips 110, and a cover 130 which is provided on the liquid ejecting surface 20*a* side of the head chip 110.

The head chip 110 has the liquid ejecting surface 20*a* on which the nozzle openings 21 are provided on the Z1 side in the third direction Z. In addition, the Z2 side of the plurality of the head chips 110 is adhered to the surface on the Z1 side of the holding member 120.

The holding member 120 has a holding portion 121 which forms a space in a groove-like form on the Z1 side. The holding portion 121 is provided to open on surfaces on both sides in the second direction Y by being continuously provided on the surface on the Z1 side of the holding member 120 in the second direction Y. In addition, in the holding member 120, by providing the holding portion 121 in a substantially central portion in the first direction X, a foot portion 122 is formed on both sides in the first direction X of the holding portion 121. That is, the foot portion 122 is only provided on both ends in the first direction X on the surface on the Z2 side of the holding member 120 and is not provided on both ends in the second direction Y.

The plurality of the head chips 110 are adhered to the holding portion 121 using an adhesive agent 140. That is, the foot portions 122 are positioned on both sides in the third direction Z with respect to the head chips 110. Here, regarding the holding member 120 and the head chips 110, the surfaces which are facing each other in the third direction Z are adhered with the adhesive agent 140. Here, a flow path or the like which supplies ink to the head chips 110 is provided in the interior of the holding member 120 which is not shown in the diagram and the flow path of the holding member 120 and the flow path of the head chips 110 are interconnected by being sealed with the adhesive agent 140. In addition, the holding member 120 may be formed by a plurality of members being laminated in the third direction Z.

In addition, the plurality of head chips 110 are lined up in the second direction Y and adhered in the holding portion 121 of the holding member 120. In the present embodiment, 6 of the head chips 110 are adhered to one holding member 120. Naturally, the number of the head chips 110 which are fixed to one holding members 120 is not limited to the number described above and may be one head chip 110 with respect to one holding member 120 or may be a plurality of two or more. Here, increasing the number of the nozzle rows by providing the plurality of the head chips 110 with respect to one head body 100 makes it possible to improve the yield compared to a case of increasing the number of rows by providing a plurality of nozzle rows in one head chip 110 with respect to only one head body 100. That is, when the number of nozzle rows in one of the head chips 110 is multiplied, the yield of the head chips 110 decreases and the manufacturing cost is high. In contrast, it is possible to improve the yield of the head chips 110 and reduce the manufacturing cost by increasing the number of nozzle rows using the plurality of the head chips 110 by fixing the plurality of the head chips 110 to the common holding member 120.

Here, the plurality of the head chips 110 of the present embodiment is fixed such that the nozzle rows are inclined with respect to the first direction X which is the transport direction of the recording sheet S in the in-plane direction of the liquid ejecting surface 20*a*. That is, the plurality of the head chips 110 of the present embodiment is fixed in a direction in which a fourth direction Xa which is the lining up direction of the nozzle openings 21 which configure a nozzle row is inclined with respect to the first direction X. In the present embodiment, the head body 100 is provided with the plurality of the head chips 110 lined up in the second direction Y and it is possible to arrange at least some of the nozzle openings 21 of the head chips 110 which are adjacent to each other in the second direction Y at positions overlapping in the first direction X. In addition, the plurality of the head bodies 100 are provided lined up in the second direction Y and it is possible to arrange at least some of the nozzle openings 21 of the head bodies 100 which are adjacent to each other in the second direction Y at positions overlapping in the first direction X. Therefore, it is possible to form the nozzle openings 21 which are lined up at the same intervals in the second direction Y of the recording head 3.

The cover 130 corresponds to the fixing board of the present embodiment and is formed of a board member of metal or the like. The cover 130 is provided on the liquid ejecting surface 20*a* side of the head body 100, that is, the Z1 side in the third direction Z of the head body 100.

The cover 130 is formed by bending a member in a flat board form and is equipped with a base 131 which is provided on the liquid ejecting surface 20*a* side, and a bending portion 132 which is provided by bending both ends of the base 131 in the second direction Y to the Z2 side in the third direction Z.

As shown in FIG. 5, the base 131 is bonded to a surface on the Z1 side in the third direction Z of the holding member 120, that is, the end surface on the Z1 side of the foot portion 122, via an adhesive agent 141.

In addition, as shown in FIG. 5, an exposure opening portion 133 for opening the nozzle openings 21 of each of the head chips 110 is provided in the base 131. In the present embodiment, the exposure opening portions 133 are provided so as to independently open for each of the head chips 110. That is, since the head body 100 of the present embodiment has 6 of the head chips 110, 6 of the independent exposure opening portions 133 are provided in the base 131. Naturally, one common exposure opening portion 133 may be provided with respect to a head body group which is formed by the plurality of the head chips 110 according to the configuration or the like of the head chips 110.

Here, in the present embodiment, since the foot portion 122 is not provided in the second direction Y of the holding portion 121, the exposure opening portion 133 is provided up to the vicinity of the bending portion 132 in the second direction Y. That is, the interval from the perimeter of the base 131 to the exposure opening portion 133 is smaller in the second direction Y than in the first direction X.

The Z1 side of the holding portion 121 of the holding member 120 is covered by the base 131.

In addition, the bending portion 132 is provided in both ends of the base 131 in the second direction Y and is formed to be a size which covers the opening area which opens on a side surface in the second direction Y of the holding portion 121. That is, the bending portion 132 is a region from the end of the base 131 in the second direction Y to the edge of the cover 130. Then, the bending portion 132 is bonded to a side surface of the holding member 120 in the second direction Y via the adhesive agent 141. Due to this, the opening to the side surface in the second direction Y of the holding portion 121 is covered and sealed by the bending portion 132.

That is, regarding the holding member 120 and the cover 130, by the end surface in the third direction Z of the foot portion 122 and the base 131 being adhered on both sides in the first direction X via the adhesive agent 141 and the side surface of the holding portion 121 which opens and the bending portion 132 being adhered on both sides in the second direction Y via the adhesive agent 141, the head chips 110 are arranged in the holding portion 121 which is a space between the holding member 120 and the cover 130. That is, the adhesive agent 140 which adheres the head chips 110 and the holding member 120 is contained in the holding portion 121 which is a space which is formed by adhering the holding member 120 and the cover 130 with the adhesive agent 141. Therefore, even when using the adhesive agent 140 into which moisture which is included in ink easily permeates as the adhesive agent 140 adhering the holding member 120 and the head chips 110, it is possible to suppress evaporation of the moisture which is included in the ink since the inside of the holding portion 121 is sealed with the adhesive agent 141 which adheres the holding member 120 and the cover 130. Here, the base 131 of the cover 130 and the liquid ejecting surface 20*a* side of the head chips 110 are preferably adhered in order to seal the inside of the holding portion 121. That is, the periphery of the exposure opening portion 133 is preferably adhered to the head chips 110 in order for moisture not to evaporate to the outside via the exposure opening portion 133. In addition, the adhesive agent 141 which adheres the holding member 120 and the cover 130 is preferably an adhesive agent into which water permeates less easily than the adhesive agent 140 which adheres the holding member 120 and the head chips 110, and which absorbs variation in the heights of the head chips 110.

In this manner, in the present embodiment, since the cover 130 and the holding member 120 are adhered by providing the bending portion 132 in the cover 130 on both sides of the second direction of the holding member 120, foot portions for adhesion with the base 131 of the cover 130 are not necessary on both sides in the second direction Y of the holding member 120. For this reason, when lining up the head bodies 100 in the second direction Y, since a foot portion is not present in a gap 101 between the head bodies 100 which are adjacent to each other, it is possible to make the gap 101 between the head bodies 100 which are adjacent to each other in the second direction Y narrow. Due to this, it is possible to provide the head chips 110 of the head bodies 100 which are adjacent to each other in the second direction Y to be contiguous and it is possible to provide the nozzle openings 21 which are provided in each of the head chips 110 of the head bodies 100 which are adjacent to each other in the second direction Y to be contiguous.

Here, in order to suppress the evaporation of moisture which is included in ink without providing the bending portion 132 which is adhered to the holding member 120 on both sides in the second direction Y of the cover 130, it is necessary to also provide foot portions on both sides in the second direction Y of the holding member 120 and adhere the end surfaces on the Z1 side of the foot portions and the base 131. In other words, it is necessary to provide the above such that the holding portion 121 only opens on the Z1 side in the third direction Z. When providing foot portions on both sides in the second direction Y in this manner, the gap 101 between the holding portions 121 of the head bodies 100 which are adjacent to each other is wide and it is not possible to provide the head chips 110 of the head bodies 100 which are adjacent to each other to be contiguous and the nozzle openings 21 are arranged to be separate in the second direction Y. That is, in order to provide the head bodies 100 which are adjacent to each other to be contiguous and provide the head chips 110 of each of the head bodies 100 to be contiguous, the foot portions 122 are preferably not provided on both sides in the second direction Y which is the lining up direction of the head bodies 100. Thus, regarding the holding portion 121, the openings which are interconnected with the space in which the head chips 110 are arranged are provided on both side surfaces in the second direction Y. In addition, in the configuration, when only adhering the cover 130 on the end surface on the Z1 side of the foot portion 122 of the holding member 120, the inside of the holding portion 121 opens to the outside on both side surfaces in the second direction Y and moisture which permeates the adhesive agent 140 which adheres the holding member 120 and the head chips 110 evaporates to the outside.

In the present embodiment, sealing the holding portion 121 which is made to open on both side surfaces in the second direction Y with the bending portion 132 of the cover 130 makes it possible to make the gap 101 between the head bodies 100 which are adjacent to each other in the second direction Y narrow without providing a foot portion on both sides in the second direction Y, to provide the nozzle openings 21 of the head bodies 100 which are adjacent to each other to be contiguous, and to suppress evaporation of moisture which permeates the adhesive agent 140 which adheres the head chips 110 and the holding member 120.

Here, in the present embodiment, a concave portion 123 is provided on the side surface in the second direction Y of the holding member 120 and the bending portion 132 is adhered to the inside of the concave portion 123. The concave portion 123 of the present embodiment is provided to open on both side surfaces in the second direction Y and provided to open on the surface on the Z1 side in the third direction Z. Since the bending portion 132 is inserted in and adhered to the concave portion 123 by providing the concave portion 123 in the holding member 120 in this manner, it is possible to facilitate the adhesion of the holding member 120 and the bending portion 132 of the cover 130. That is, by the concave portion 123 being provided in the holding member 120, since the adhesive agent 141 is filled between the holding member 120 and the bending portion 132 of the cover 130 by capillary force simply by coating the adhesive agent 141 between the end of the bending portion 132 of the cover 130 which is inserted in the concave portion 123 and the concave portion 123, coating the adhesive agent 141 on a surface which does not have the concave portion 123 and which faces a different direction along the end of the bending portion 132 with respect to the gap between the holding member 120 and the bending portion 132 is not necessary, and it is possible to simplify the adhering step. In addition, in the present embodiment, by providing the concave portion 123 in the holding member 120, the protrusion amount in the second direction Y of the bending portion 132 of the cover 130 is small, it is possible to make the gap 101 between the head bodies 100 which are adjacent to each other in the second direction Y narrower, and it is possible to make the interval of the nozzle openings 21 of the head bodies 100 which are adjacent to each other narrower. In addition, by providing the concave portion 123 in the holding member 120 and inserting the bending portion 132 in the concave portion 123, even when variations are generated in the bending angle of the bending portion 132, it is possible to suppress the bending portion 132 from interfering with the adjacent head bodies 100 since it is possible to make the protrusion amount to the second direction Y of the bending portion 132 small. Due to this, it is also make the gaps 101 between the head bodies 100 which are adjacent to each other narrow.

In this manner, in the recording head 3 of the present embodiment, since it is possible to make the gaps 101 between the head bodies 100 which are adjacent to each other in the second direction Y narrow when lining up the plurality of the head bodies 100 in which moisture evaporation of ink is suppressed in the second direction Y in the holder 200, it is possible to make the intervals of the nozzle openings 21 of the adjacent head bodies 100 narrow. In addition, since it is possible to make the intervals of the nozzle openings 21 of the adjacent head bodies 100 narrow, it is possible to line up the plurality of the head bodies 100 in a straight line which extends in the second direction Y and it is possible to make the width of the recording head 3 in the first direction X small.

In the present embodiment, since it is possible to make the width of the recording head 3 in the first direction X small, it is possible to shorten the distance between the first transport roller 5 and the second transport roller 6 in the first direction X, it is easy to fix the posture of the recording sheet S, and it is possible to improve the printing quality. In addition, it is possible to miniaturize the recording head 3 and the ink jet recording apparatus 1.

As shown in FIG. 3, the head body 100 of the present embodiment has substantially a parallelogram shape when viewed in plan view from the liquid ejecting surface 20*a* side. This is because the fourth direction Xa which is the lining up direction of the nozzle openings 21 which configure the nozzle rows of each of the head chips 110 is provided to incline with respect to the first direction X which is the transport direction of the recording sheet S as described above, and the outer shape of the head body 100 is formed to be substantially a parallelogram in the same manner as the fourth direction Xa which is the direction in which the nozzle row inclines. Naturally, the shape when viewed in plan view from the liquid ejecting surface 20*a* side of the head body 100 is not limited to a substantially parallelogram shape and may be a rectangle, a trapezoid, a polygon, or the like.

By arranging the plurality of the head bodies 100 to form the recording head 3 in this manner, effects such as yield in terms of manufacturing, ease of processing, ease of flattening the plane of the cover 130 which is a fixing board, and the like are exhibited.

In addition, in the present embodiment, regarding the head body 100, the liquid ejecting surface 20*a* and the surface on the Z1 side of the cover 130 are wiping surfaces 102 which are wiped by a wiper. That is, the wiping surface 102 is provided at a position facing the recording sheet S. Here, as shown in FIG. 3, a wiper 150 of the present embodiment is arranged along the fourth direction Xa which is the lining up direction of the nozzle openings 21 and a relative moving direction Ya with respect to the head body 100 of the wiper 150 matches the second direction Y. As the wiper 150, it is possible to use, for example, an elastic material such as rubber or an elastomer, a porous material such as a sponge, fabrics such as textiles, knitted materials, or non-woven fabric. In addition, in the present embodiment, the wiper 150 continuously wipes a plurality of the wiping surfaces 102. In other words, the wiper 150 wipes the plurality of the wiping surfaces 102 at the same time by moving in parallel to the relative moving direction Ya with respect to the plurality of the wiping surfaces 102 without moving vertically in the third direction Z for any of the wiping surfaces 102. This is because, for example, in a case of moving the wiper 150 in the third direction Z for each of the wiping surfaces 102, positional control of the wiper 150 is difficult and there is a concern that unwiped regions will be generated and it will take time to carry out the wiping. By wiping the plurality of the wiping surfaces 102 without moving the wiper 150 in the third direction Z, the time is shortened and it is possible to suppress wiping failures.

Then, in the present embodiment, as described above, since the plurality of the head bodies 100 are lined up with the gaps 101 therebetween, the gaps 101 open between the wiping surfaces 102 of the adjacent head bodies 100. Here, in the present embodiment, the gaps 101 between the adjacent head bodies 100 are formed with the same width in the third direction Z and the first direction X; however, the invention is not particularly limited thereto and, for example, the gap on the wiping surface 102 side and the gap on the holder 200 side may have different widths depending on the outer shape of the head body 100. Providing the gaps 101 between the head bodies 100 which are jointly provided in the second direction Y in this manner makes it possible to relatively align the nozzle openings 21 of the plurality of the head bodies 100. Here, in the adjacent head bodies 100, when portions thereof are arranged so as to come into contact with each other, it is not possible to adjust the relative position based on the nozzle openings 21 of the plurality of the head bodies 100. In the present embodiment, it is possible to adjust the relative position of the head bodies 100 by providing the gaps 101 over the entirety of the surfaces where the head bodies 100 which are adjacent to each other in the second direction Y are facing each other. That is, the gaps 101 between the head bodies 100 which are adjacent to each other are provided so as to continuously open over the surface on the Z1 side in the third direction Z and the surface on both sides in the first direction X.

As shown in FIG. 5 and FIG. 7, an elastic member 160 is provided in the gap 101 between two of the wiping surfaces 102 which are adjacent to each other in the second direction Y, and the opening on the wiping surface 102 side of the gap 101, that is, the opening on the Z1 side, is blocked by the elastic member 160. Here, the elastic member 160 is formed of an elastic material such as rubber and elastomer. In present embodiment, the elastic member 160 in a board form is used. In addition, in the present embodiment, the elastic member 160 is provided continuously over the opening edge of the surface on the Z1 side in the third direction Z of the gap 101 so as to block the opening of the gap 101 between two of the wiping surfaces 102 which are adjacent to each other. That is, the elastic member 160 is provided to be the same length as the length of the head bodies 100 in the fourth direction Xa. Here, the elastic member 160 has a height which does not reach the surface on the Z1 side which holds the head bodies 100 of the holder 200 in the third direction Z. In other words, in the third direction Z, the elastic member 160 has a lower height than the gap 101 and, by the elastic member 160 being provided on the opening side to the wiping surface 102 of the gap 101, a space in which the elastic member 160 is not provided is provided on the holder 200 side of the gap 101 between the head bodies 100 which are adjacent to each other. In addition, regarding the elastic member 160, the end surface on the Z1 side is arranged at the same height as the wiping surface 102 of the head body 100 in the third direction Z, that is, a position flush with the surface, or further to the Z2 side than the wiping surface 102. Here, in a case of where the end surface on the Z1 side of the elastic member 160 is arranged further to the Z2 side than the wiping surface 102, a retracting amount from the wiping surface 102 of the elastic member 160 may be determined in order for ink which is accumulated in a space which is formed by the side surface in the second direction Y of the head body 100 and the end surface of the elastic member 160 not to easily drop due to the surface tension. In other words, when the retracting amount from the wiping surface 102 of the elastic member 160 is excessively large, it is not possible to maintain the meniscus of the ink which is accumulated in the space and ink drops at an unexpected timing. Here, the end surface on the Z1 side of the elastic member 160 may protrude further to the Z1 side than the wiping surface 102; however, if the elastic member 160 protrudes further to the Z1 side than the wiping surface 102, when the wiper 150 wipes the wiping surface 102, the wiper 150 comes into contact with the elastic member 160 and the wiper 150 is quickly worn and there is a concern that some of the wiper 150 or the elastic member 160 will become foreign matter due to the wiper 150 coming into contact with the elastic member 160, which is not preferable. Therefore, arranging the end surface of the elastic member 160 on the Z1 side at the same height as the wiping surface 102 of the head body 100 in the third direction Z or further to the Z2 side than the wiping surface 102 makes it possible to suppress wear of the wiper 150 due to contact with the elastic member 160 and to suppress the generation of foreign matter from the wiper 150 and the elastic member 160.

The elastic member 160 has a slightly wider thickness than the width of the gap 101 in the second direction Y. For this reason, the elastic member 160 is inserted in the gap 101 by being elastically deformed and is held by being in contact with the side surface of the head body 100 in the second direction Y by elastic force.

Here, in the present embodiment, the bending portion 132 of the cover 130 is arranged on the wiping surface 102 side on the side surface in the second direction Y of the head body 100 in which the elastic member 160 is provided. For this reason, for example, in a case where a liquid-repellent film 134 which has a liquid-repellent property with respect to ink is provided on a surface on the Z1 side of the cover 130, the liquid-repellent film 134 is preferably removed beforehand from a portion with which the elastic member 160 of the cover 130 is in contact, that is, a surface of the bending portion 132. Due to this, it is possible to increase the surface roughness of the portion from which the liquid-repellent film 134 of the cover 130 is removed compared to the portion in which the liquid-repellent film 134 is provided, and it is possible to suppress the positional shifting of the elastic member 160 which is provided in the gap 101.

By providing the elastic member 160 so as to block the opening on the wiping surface 102 side in the gap 101 of the lined up wiping surface 102 in this manner, it is possible to suppress ink from entering the gap 101 of the adjacent wiping surface 102 when wiping the lined up wiping surface 102 with the wiper 150. Therefore, it is possible to suppress mist which is generated when ink droplets protrude or to suppress ink from entering the gap 101 during wiping, and to thereby suppress contamination of the recording sheet S due to ink which is accumulated in the gap 101 dropping at an unexpected timing.

In addition, by providing the elastic member 160 in the gap 101 and exposing the elastic member 160 on the wiping surface 102, foreign matter is not easily generated even when the wiper 150 comes into contact with the elastic member 160, and it is possible to suppress contamination of the recording sheet S by foreign matter or ink discharge failures due to the clogging or the like of the nozzle openings 21 by the foreign matter. Here, it is also possible to consider a method of blocking the gap 101 with an adhesive agent or a mold agent; however, in a case where the adhesive agent or the mold agent is exposed in the opening on the wiping surface 102 side, problems occur such as, the wiper 150 coming into contact with the adhesive agent or the mold agent such that some thereof becomes foreign matter and the adhesive agent or the mold agent which became foreign matter drops onto and contaminates the recording sheet S or the wiper 150 imprints the adhesive agent or the mold agent which became foreign matter in the next nozzle opening 21 and ink discharge failures are generated such as clogging of the nozzle openings 21 and flying direction of ink droplets being shifted.

In addition, since the elastic member 160 of the present embodiment has a height in the third direction Z, the opening on the Z1 side which is the wiping surface 102 side is also blocked by the elastic member 160 in the opening on the first direction X side of the gap 101. For this reason, it is possible to suppress ink which is pushed away when wiping the wiping surface 102 with the wiper 150 from entering the gap 101 from the side surface of the head body 100, that is, the opening in the first direction X. Due to this, it is possible to suppress the ink which enters the gap 101 from a surface other than the wiping surface 102 from dropping on the recording sheet S at an unexpected timing.

Furthermore, the elastic member 160 of the present embodiment is not continuously provided over the entire surface of the gap 101 and a space is provided in the gap 101 on the Z2 side which is the holder 200 side of the head body 100. For this reason, it is possible to suppress the positional shifting of the head body 100 by reducing the pressure with which the elastic member 160 presses the head body 100 due to the elastic force. That is, when the pressure with which the elastic member 160 presses the head body 100 in the second direction Y is large, there is a concern that positional shifting of the head body 100 will be generated and a landing position shifting caused by the relative position of the nozzle openings 21 being shifted will be generated; however, in the present embodiment, making the area of the head body 100 which the elastic member 160 presses narrow compared to the area of the gap 101 makes it possible to suppress landing position shifting of the ink droplets due to the positional shifting of the nozzle openings 21 by reducing the pressure with which the elastic member 160 presses the head body 100, and to improve the printing quality. In addition, by reducing the pressure with which the head body 100 is pressed by the elastic member 160, it is possible to easily relatively align the plurality of the head bodies 100 even in a state of holding the elastic member 160 in the gap 101.

Furthermore, in the present embodiment, since the elastic member 160 is held in the gap 101 by its own elastic force, it is possible to easily attach and detach the head body 100 from the holder 200 when replacing or maintaining the head body 100, or the like. In addition, even in a case where the positional shifting of the head body 100 is generated, it is possible to correct the positional shifting of the head body 100 in a state of holding the elastic member 160 in the gap 101. In contrast, for example, in a case of adhering the head bodies 100 using an adhesive agent, it is not possible to easily detach the head body 100 from the holder 200 and it is also not possible to correct the positional shifting of the head body 100 with respect to the holder 200.

Furthermore, in the present embodiment, since the elastic member 160 is held in the gap 101 between the head bodies 100 due to the elastic force, controlling a coating amount of the adhesive agent with high precision such that an adhesive agent or a mold agent is coated in the gap 101 without a gap and excess adhesive agent or mold agent does not enter the liquid ejecting surface 20*a* or the like is not necessary, and the time for curing the adhesive agent is not necessary and it is possible to shorten the manufacturing time by simplifying the manufacturing steps.

Here, in the present embodiment, the foot portion 122 is provided on both sides of the holding member 120 in the first direction X; however, the foot portion 122 need not be provided. That is, the head chips 110 may be adhered to the surface on the Z1 side of the holding member 120 and the bending portion 132 may be provided on both sides of the cover 130 in the first direction X and the second direction Y. That is, the bending portion 132 is provided in the cover 130 over the perimeter in the in-plane direction of the liquid ejecting surface 20*a*, and the cover 130 may be adhered over the perimeter of the side surface of the holding member 120. Due to this, it is possible to make the width in the first direction X of the recording head 3 smaller. In addition, making the width in the first direction X of the recording head 3 small also makes it possible to provide the plurality of the recording heads 3 to be contiguous with the first direction X. Here, while it is necessary to form the cover 130 which has the bending portion 132 over the perimeter of the base 131 by drawing or the like, it is not possible to sufficiently secure the length of the bending portion 132 in the drawing, and there are cases where manufacturing is difficult. In addition, it is possible to improve the strength in the third direction Z of the head body 100 by adhering the end surface on the Z1 side of the foot portion 122 to the base 131 of the cover 130 as the present embodiment. In addition, adhering the end surface on the Z1 side of the foot portion 122 to the base 131 of the cover 130 makes it possible to support the pressure when adhering the cover 130 and the holding member 120 using the foot portion 122, and to suppress destruction or the like of the head chips 110 by suppressing the pressure directly applied to the head chips 110.

In addition, in the present embodiment, the foot portion 122 is not provided on both sides in the second direction Y of the holding member 120; however, it is possible to improve the strength of the head body 100 in the third direction Z by providing the foot portion 122 on both sides in the second direction Y. In this case, making the length in the second direction Y of the end surface on the Z1 side of the foot portion 122 which is provided on both sides in the second direction Y narrower than the length in the first direction X of the end surface on the Z1 side of the foot portion 122 which is provided on both sides in the first direction X makes it possible to make the gap 101 between the head bodies 100 which are adjacent to each other narrower in the second direction Y. In addition, in this case, adhering the bending portion 132 and the side surface of the holding member 120 with the adhesive agent 141 on both sides in the second direction Y makes it possible to secure a region which is necessary for adhesion with the cover 130 on the side surface of the holding member 120 and to efficiently suppress evaporation of moisture.

As shown in FIG. 3, the head body 100 of the present embodiment has substantially a parallelogram shape when viewed in plan view from the liquid ejecting surface 20*a* side. This is because the fourth direction Xa which is the lining up direction of the nozzle openings 21 which configure the nozzle rows of each of the head chips 110 is provided to incline with respect to the first direction X which is the transport direction of the recording sheet S as described above, and the outer shape of the head body 100 is formed to be substantially a parallelogram in the same manner as the fourth direction Xa which is the direction in which the nozzle row inclines. Naturally, the shape when viewed in plan view from the liquid ejecting surface 20*a* side of the head body 100 is not limited to a substantially parallelogram shape and may be a rectangle, a trapezoid, a polygon, or the like.

By arranging the plurality of the head bodies 100 to form the recording head 3 in this manner, effects such as yield in terms of manufacturing, ease of processing, ease of flattening the plane of the cover 130 which is a fixing board, and the like are exhibited.

Figure 8:
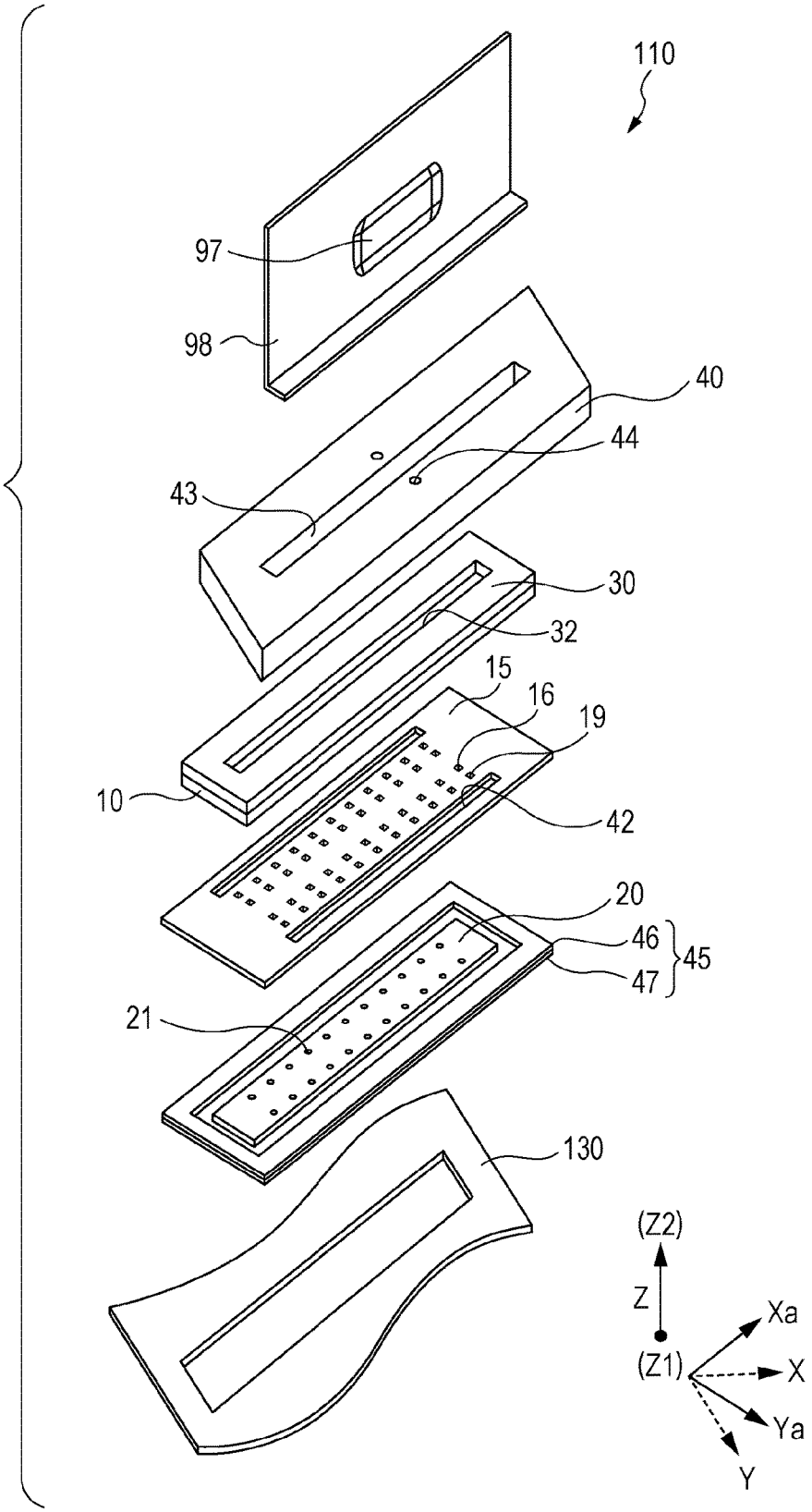
FIG. 8 is an exploded perspective view of a head chip according to embodiment 1 of the invention.
Figure 9:
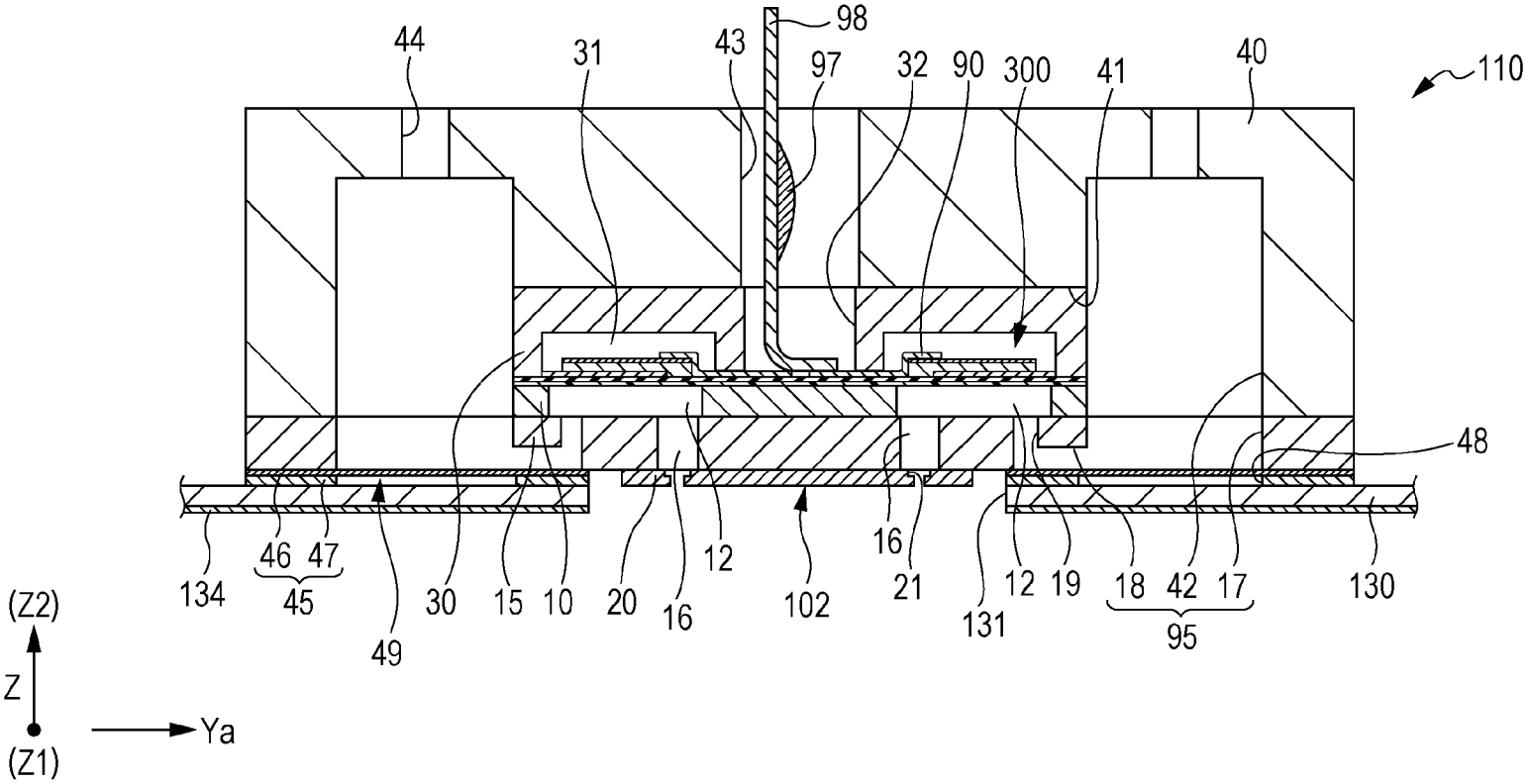
FIG. 9 is a cross-sectional view of the head chip according to embodiment 1 of the invention.

Here, detailed description will be given below of an example of the head chip 110 of the head body 100; however, naturally, the configuration of the head chip 110 is not limited to the configuration below. Here, FIG. 8 is a perspective view of the head body according to embodiment 1 of the invention and FIG. 9 is a cross-sectional view in the second direction Y of the head body.

As shown in the diagram, the head chip 110 of the present embodiment is provided with a plurality of members such as a flow path-forming substrate 10, an interconnecting board 15, a nozzle plate 20, a protective substrate 30, a compliance substrate 45, and a case 40 and the plurality of the members are bonded using an adhesive agent or the like.

As shown in the diagram, pressure generating chambers 12 which are divided by a plurality of partition walls are lined up along the direction in which the plurality of the nozzle openings 21 are lined up on the flow path-forming substrate 10 which configures the head chip 110 by carrying out anisotropy etching from one surface side. Here, in the present embodiment, the direction in which the pressure generating chambers 12 are lined up matches the fourth direction Xa and also the flow path-forming substrate 10 is provided with a plurality of rows, 2 rows in the present embodiment, in which the pressure generating chambers 12 are lined up in the fourth direction Xa. The row lining up direction in which a plurality of rows of the pressure generating chamber 12 in which the pressure generating chambers 12 are formed along the fourth direction Xa is called a fifth direction Ya below. Here, in the present embodiment, a direction which is orthogonal to the fourth direction Xa and the fifth direction Ya matches the third direction Z. In addition, the head chip 110 of the present embodiment is mounted on the recording head 3 such that the fourth direction Xa which is the lining up direction of the nozzle openings 21 inclines with respect to the first direction X which is the transport direction of the recording sheet S.

In addition, a supply path or the like of which the opening area is narrower than the pressure generating chamber 12 and which applies a flow path resistance to ink which enters the pressure generating chamber 12 may be provided on one end side in the fifth direction Ya of the pressure generating chambers 12 in the flow path-forming substrate 10.

In addition, as shown in FIG. 9, the interconnecting board 15 is bonded to one surface side of the flow path-forming substrate 10. In addition, the nozzle plate 20 on which the plurality of the nozzle openings 21 which are interconnected to each of the pressure generating chambers 12 are punched is bonded to the interconnecting board 15. In the present embodiment, the Z1 side, which is one surface in the third direction Z in which the nozzle openings 21 of the nozzle plate 20 open, is the liquid ejecting surface 20*a*.

Nozzle interconnecting paths 16 which interconnect the pressure generating chambers 12 and the nozzle openings 21 are provided in the interconnecting board 15. The interconnecting board 15 has a larger area than the flow path-forming substrate 10 and the nozzle plate 20 has a smaller area than the flow path-forming substrate 10. It is possible to reduce costs by making the area of the nozzle plate 20 comparatively small in this manner.

In addition, as shown in the diagram, a first manifold portion 17 and a second manifold portion 18 which configure a portion of a manifold 95 are provided on the interconnecting board 15.

The first manifold portion 17 is provided passing through the interconnecting board 15 in the third direction Z.

In addition, the second manifold portion 18 is provided up to half way in the third direction Z by opening on the nozzle plate 20 side of the interconnecting board 15 without passing through the interconnecting board 15 in the third direction Z.

Furthermore, supply interconnecting paths 19 which are interconnected to one end of the pressure generating chambers 12 in the second direction Y are independently provided in the interconnecting board 15 for each of the pressure generating chambers 12. The supply interconnecting paths 19 interconnect the second manifold portions 18 and the pressure generating chambers 12.

The nozzle openings 21 which are interconnected via each of the pressure generating chambers 12 and an nozzle interconnecting path 16 are formed in the nozzle plate 20. That is, the nozzle openings 21 which eject inks which are the same type of liquid are lined up in the fourth direction Xa and 2 rows of the nozzle openings 21 which are lined up in the fourth direction Xa are formed in the fifth direction Ya. Here, although not specifically shown in the diagram, a liquid-repellent film which has liquid-repellent property with respect to ink is provided on the liquid ejecting surface 20*a* on the Z1 side where the nozzle openings 21 of the nozzle plate 20 open.

On the other hand, a vibration board is formed on the opposite surface side to the interconnecting board 15 of the flow path-forming substrate 10. In addition, a piezoelectric actuator 300 which is a pressure generating means of the present embodiment is formed by a first electrode, a piezoelectric layer, and a second electrode being sequentially laminated on the vibration board. In general, the configuration is made by setting either of the electrodes of the piezoelectric actuator 300 as a common electrode and carrying out patterning on the other electrode and the piezoelectric layer for each of the pressure generating chambers 12.

In addition, the protective substrate 30 which has substantially the same size as the flow path-forming substrate 10 is bonded to the surface on the piezoelectric actuator 300 side of the flow path-forming substrate 10. The protective substrate 30 has a piezoelectric actuator holding portion 31 which is a space for protecting the piezoelectric actuator 300. In addition, a through hole 32 is provided in the protective substrate 30 to pass therethrough in the third direction Z. The end of a lead electrode 90 which is drawn from the electrode of the piezoelectric actuator 300 extends so as to be exposed in the through hole 32 and the lead electrode and a wiring substrate 98 on which a driving circuit 97 such as a driving IC is mounted are electrically connected in the through hole 32.

In addition, the case 40 which forms the manifold 95 which passes through the plurality of the pressure generating chambers 12 is fixed to the protective substrate 30 and the interconnecting board 15. The case 40 has substantially the same shape as the interconnecting board 15 described above in plan view and is bonded to the protective substrate 30 and is also bonded to the interconnecting board 15 described above. In detail, the case 40 has a concave portion 41 with a depth in which the flow path-forming substrate 10 and the protective substrate 30 are accommodated on the protective substrate 30 side. The concave portion 41 has a wider opening area than the surface which is bonded to the flow path-forming substrate 10 of the protective substrate 30. Then, the opening surface on the nozzle plate 20 side of the concave portion 41 is sealed by the interconnecting board 15 in a state where the flow path-forming substrate 10 or the like is accommodated in the concave portion 41. Due to this, a third manifold portion 42 is formed on the periphery of the flow path-forming substrate 10 by the case 40, the flow path-forming substrate 10, and the protective substrate 30. Then, the manifold 95 of the present embodiment is formed by the third manifold portion 42 and the first manifold portion 17 and the second manifold portion 18 which are provided in the interconnecting board 15.

In addition, the compliance substrate 45 is provided on the surface where the first manifold portion 17 and the second manifold portion 18 of the interconnecting board 15 open. The compliance substrate 45 seals the opening of the first manifold portion 17 and the second manifold portion 18.

The compliance substrate 45 is equipped with a sealing film 46 and a fixing substrate 47 in the present embodiment.

The sealing film 46 is formed by a thin film (for example, polyphenylene sulfide (PPS) which has flexibility, stainless steel (SUS), or the like). In addition, the fixing substrate 47 is formed by a hard material such as metal such as stainless steel (SUS). Since a region of the fixing substrate 47 which is opposed to the manifold 95 is an opening portion 48 which is completely removed in the thickness direction, one surface of the manifold 95 is a compliance portion 49 which is a flexible portion which is only sealed by the sealing film 46 which has flexibility.

In addition, in the present embodiment, the cover 130 which is a fixing board is adhered to the opposite surface side to the interconnecting board 15 of the compliance substrate 45. That is, the exposure opening portion 133 which is provided in the base 131 of the cover 130 has a wider opening area than the area of the nozzle plate 20 and exposes the liquid ejecting surface 20*a* of the nozzle plate 20 in the exposure opening portion 133. Naturally, the cover 130 is not limited thereto and, for example, the exposure opening portion 133 of the cover 130 is made to have a smaller opening area than the outer shape of the nozzle plate 20 and the cover 130 may be in contact with or adhered to the liquid ejecting surface 20*a* of the nozzle plate 20. Naturally, even in a case where the exposure opening portion 133 of the cover 130 is made to have a smaller opening area than the outer shape of the nozzle plate 20, the cover 130 may be provided such that the cover 130 and the liquid ejecting surface 20*a* do not come into contact. That is, the cover 130 being provided on the liquid ejecting surface 20*a* side has a meaning including the cover 130 not being in contact with the liquid ejecting surface 20*a* and also the cover 130 being in contact with the liquid ejecting surface 20*a*.

In addition, in the present embodiment, the cover 130 is adhered to the fixing substrate 47 of the compliance substrate 45. Due to this, it is possible to seal the holding portion 121 between the cover 130 and the holding member 120 as described above, and it is possible to suppress moisture evaporation of ink.

Here, an introduction path 44 interconnected to the manifold 95 and for supplying ink to each of the manifold 95 is provided in the case 40. In addition, a connection port 43 in which the wiring substrate 98 is inserted is provided in the case 40 to be interconnected to the through hole 32 of the protective substrate 30.

In the head chips 110 with this configuration, when ejecting ink, ink is taken in from the storing means via the introduction path 44 and the inside of the flow path is filled with the ink from the manifold 95 to the nozzle openings 21. After that, following the signal from the driving circuit 97, by applying voltage to each of the piezoelectric actuators 300 which corresponds to the pressure generating chambers 12, the vibration board is flexibly deformed along with the piezoelectric actuator 300. Due to this, the pressure inside the pressure generating chamber 12 is increased and ink droplets are ejected from predetermined nozzle openings 21.

Here, description will be given of a method for manufacturing the recording head 3 with reference to FIG. 10 to FIG. 13. Here, FIG. 10 to FIG. 13 are side surface views which show a method for manufacturing the recording head.

Figure 10:
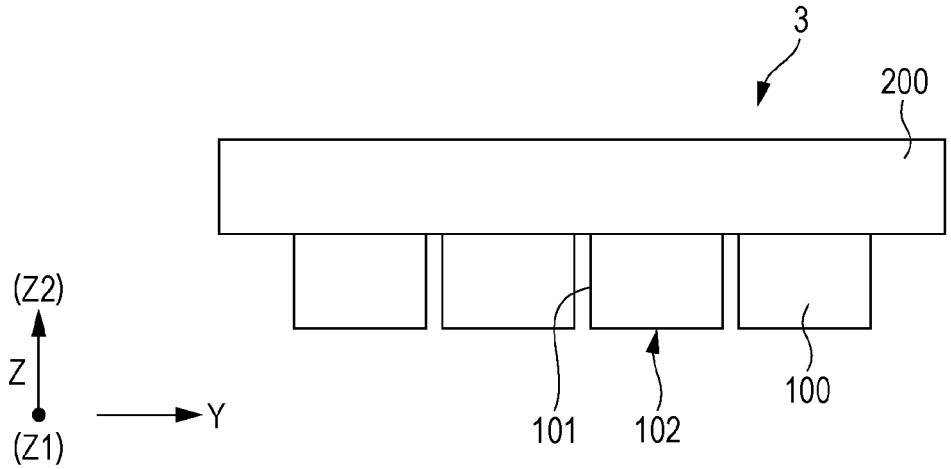
FIG. 10 is a side surface view showing a method of manufacturing the recording head according to embodiment 1 of the invention.

As shown in FIG. 10, the plurality of the head bodies 100 are fixed to the holder 200 in a state of alignment with each other.

Figure 11:
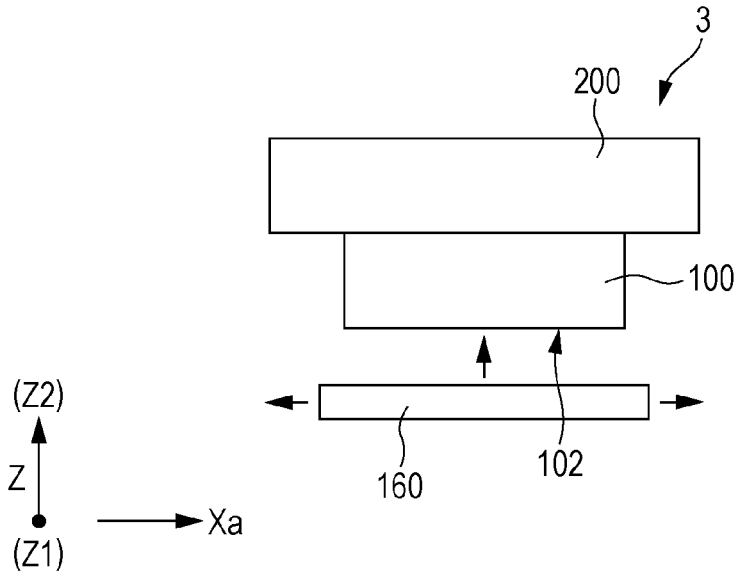
FIG. 11 is a side surface view showing the method of manufacturing the recording head according to embodiment 1 of the invention.
Figure 12:
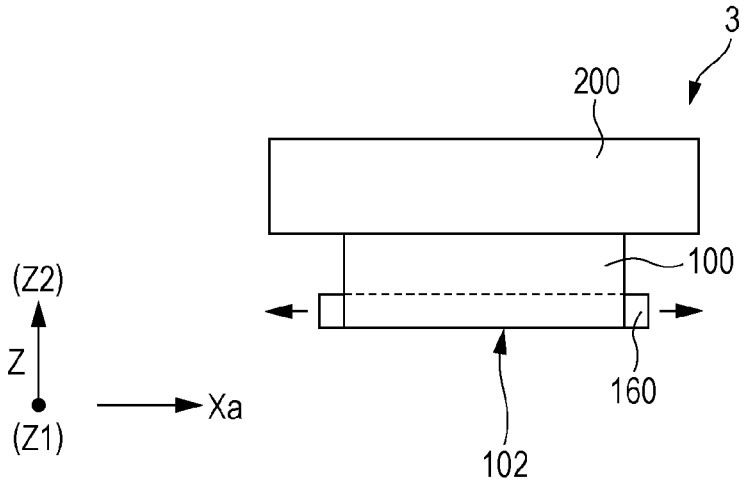
FIG. 12 is a side surface view showing the method of manufacturing the recording head according to embodiment 1 of the invention.

Next, as shown in FIG. 11, the elastic member 160 is inserted in the gap 101 (refer to FIG. 5) of the adjacent head bodies 100 as shown in FIG. 12 in a state of stretching in the fourth direction Xa. That is, stretching the elastic member 160 in the fourth direction Xa makes the thickness of the elastic member 160 in the second direction Y is thin and makes it possible to easily insert the elastic member 160 in the gap 101.

Figure 13:
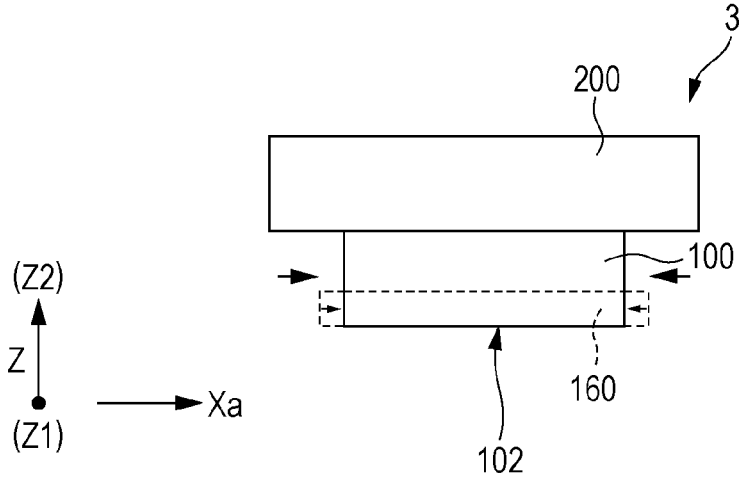
FIG. 13 is a side surface view showing the method of manufacturing the recording head according to embodiment 1 of the invention.

Next, as shown in FIG. 13, the stretching of the elastic member 160 is contracted by the elastic force. That is, using elastic force which tries to make the thickness of the elastic member 160 in the fourth direction Xa thicker than the width of the gap 101 in the gap 101, the elastic member 160 is made to come into contact with the inner surface of the gap 101, that is, the side surface of the head body 100. Due to this, it is possible to hold the elastic member 160 by the elastic force thereof in a state of elastic deformation in the gap 101.

It is possible to easily attach and detach one head body 100 from the holder 200 by providing the elastic member 160 in the gap 101 using the elastic deformation of the elastic member 160 in a state where the head body 100 is held by the holder 200 in this manner. Therefore, even after replacing one head body 100, it is possible to easily provide the elastic member 160 in the gap 101.

Here, in the present embodiment, the wiping surface 102 of one arbitrary head body 100 out of 6 head bodies 100 corresponds to the first wiping surface, and the head body 100 which is lined up in the one arbitrary head body 100 via the gap 101 corresponds to the target wiping member. In other words, the wiping surface 102 of the head body 100 which is lined up in the one arbitrary head body 100 via the gap 101 corresponds to the second wiping surface.

Embodiment 2

Figure 14:
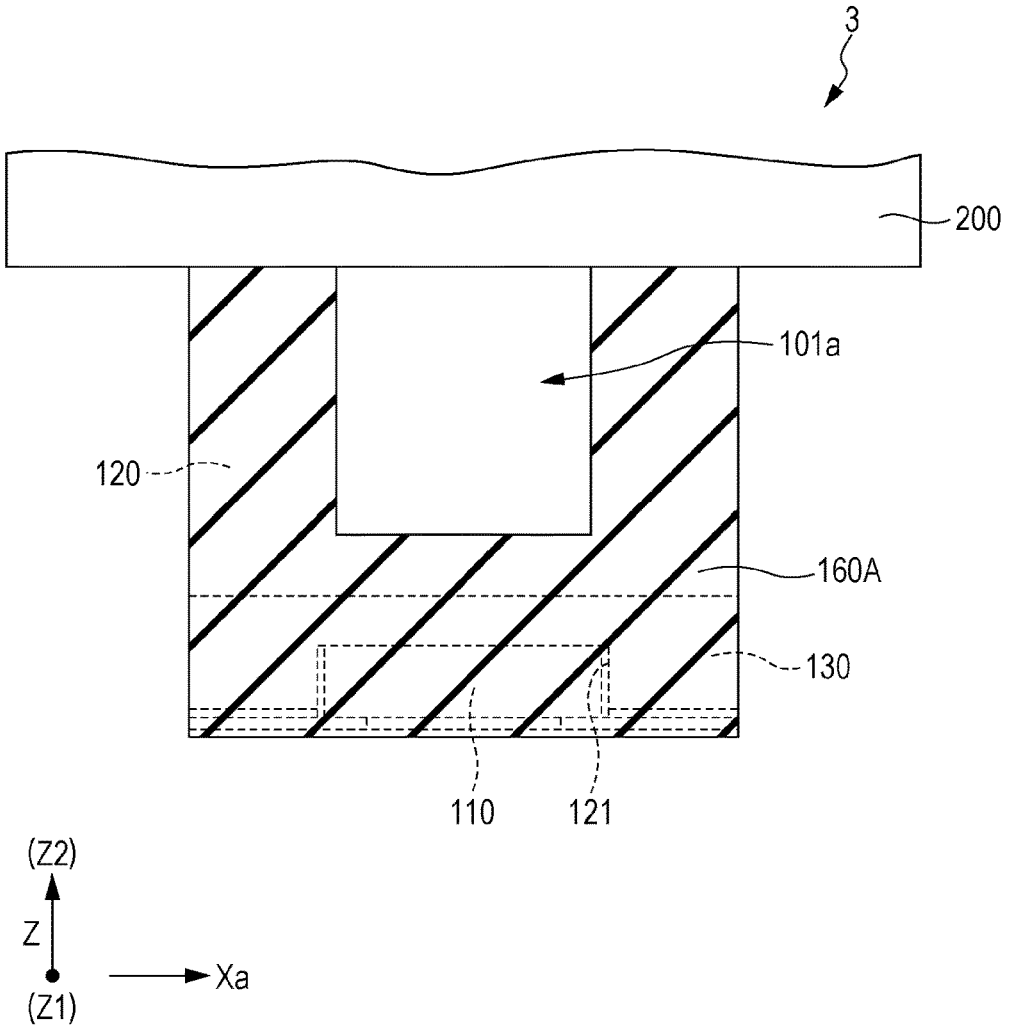
FIG. 14 is a cross-sectional view of main portions of a recording head according to embodiment 2 of the invention.
Figure 15:
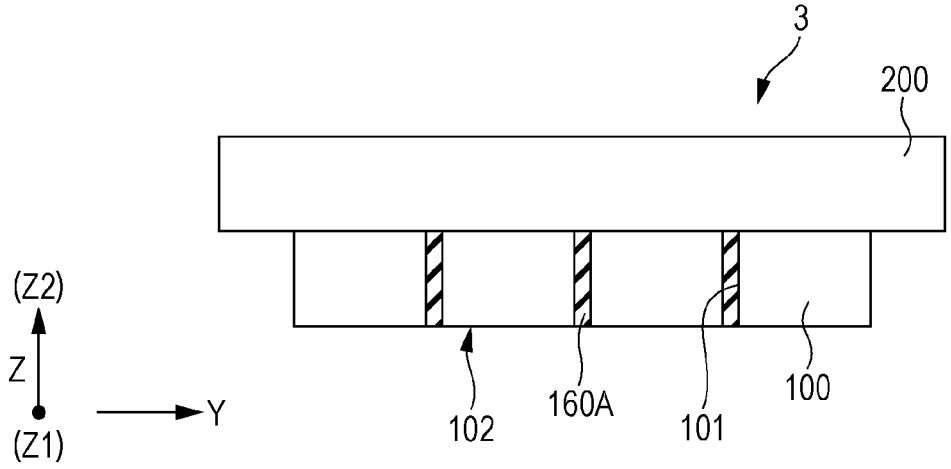
FIG. 15 is a cross-sectional view of main portions of the recording head according to embodiment 2 of the invention.

FIG. 14 is a cross-sectional view where a main portion of the recording head according to embodiment 2 of the invention is enlarged and FIG. 15 is a side surface view of the recording head according to embodiment 2. Here, the same reference numerals are given to the same members as the embodiment described above and overlapping description thereof is omitted.

As shown in the diagram, in the present embodiment, an elastic member 160A is held in the gap 101 between the head bodies 100 which are adjacent in the second direction Y in a state of elastic deformation.

Here, the elastic member 160A has a shape which follows the opening of the gap 101. That is, the elastic member 160A is provided along the opening on the Z1 side which is the wiping surface 102 side which faces the recording sheet S of the head body 100 and the opening on both side surfaces in the first direction X which is orthogonal to the ejecting direction of the ink.

In other words, the elastic member 160A is provided in a so-called U shape along three sides excluding one side which is held by the holder 200 on the side surface which forms the gap 101 of the head bodies 100 so as to block the opening on the Z1 side of the gap 101 and the opening on both sides in the second direction Y, and a space portion 101*a* in which the elastic member 160A is not provided is formed on the inner side of the opening of the gap 101, that is, on the central portion side of the gap 101.

It is possible to suppress ink from entering the gap 101 from the opening on the first direction X side by providing the elastic member 160A so as to block the opening in the first direction X of the gap 101 in this manner. In addition, it is possible to suppress the generation of foreign matter when the wiper 150 wipes the wiping surface 102 even when the wiper 150 comes into contact with the elastic member 160A.

In addition, by providing the elastic member 160A so as to form the space portion 101*a*, the elastic member 160A comes into contact with the side surface of the opening side of the head body 100 at a narrower area than the side surface which forms the gap 101 of the head bodies 100. Therefore, it is possible to suppress positional shifting or the like of the head body 100 by reducing the pressure which presses the head body 100 due to the elastic force of the elastic member 160A.

Furthermore, the elastic member 160A partially has a height which reaches the surface on the Z2 side which is held by the holder 200 from the wiping surface 102 on the Z1 side in the third direction Z. For this reason, due to the end surface on the Z2 side of the elastic member 160A being in contact with the holder 200, positional shifting is not easily generated in the gap 101. Due to this, it is possible to suppress defects such as the gap 101 opening on the wiping surface 102 due to positional shifting of the elastic member 160A or wear of the wiper 150 and the wear of the elastic member 160A being quicker due to the elastic member 160A protruding from the wiping surface 102.

Here, in the present embodiment, the surface which faces the recording sheet S of the head body 100 is the wiping surface 102 which is wiped with the wiper 150; however, the invention is not particularly limited thereto and, for example, it is also possible for the side surface in the first direction X of the head body 100 to be a wiping surface which is wiped by the wiper. That is, even in a case of wiping the side surface of the head body 100 with the wiper in the first direction X, suppressing ink from entering the gap 101 from the wiping surface which is the side surface on the first direction X side of the head body 100 by providing the elastic member 160A which blocks the opening on the first direction X side of the gap 101 makes it possible to suppress ink which is accumulated in the gap 101 from dropping at an unexpected timing. Naturally, even when making both of the liquid ejecting surface 20*a* side of the head body 100 and the side surface in the first direction X wiping surfaces which are wiped by the wiper, it is possible to suppress ink from entering the gap 101 in the elastic member 160A of the present embodiment and the generation of foreign matter by a wiper. Here, it is sufficient if the elastic member 160A is provided so as to not protrude further than the wiping surface in the opening on the wiping surface side which is wiped by the wiper and the elastic member 160A may be provided to protrude from the side surface in the first direction X of the head body 100 in a case where the side surface in the first direction X of the head body 100 is not the wiping surface.

Figure 16:
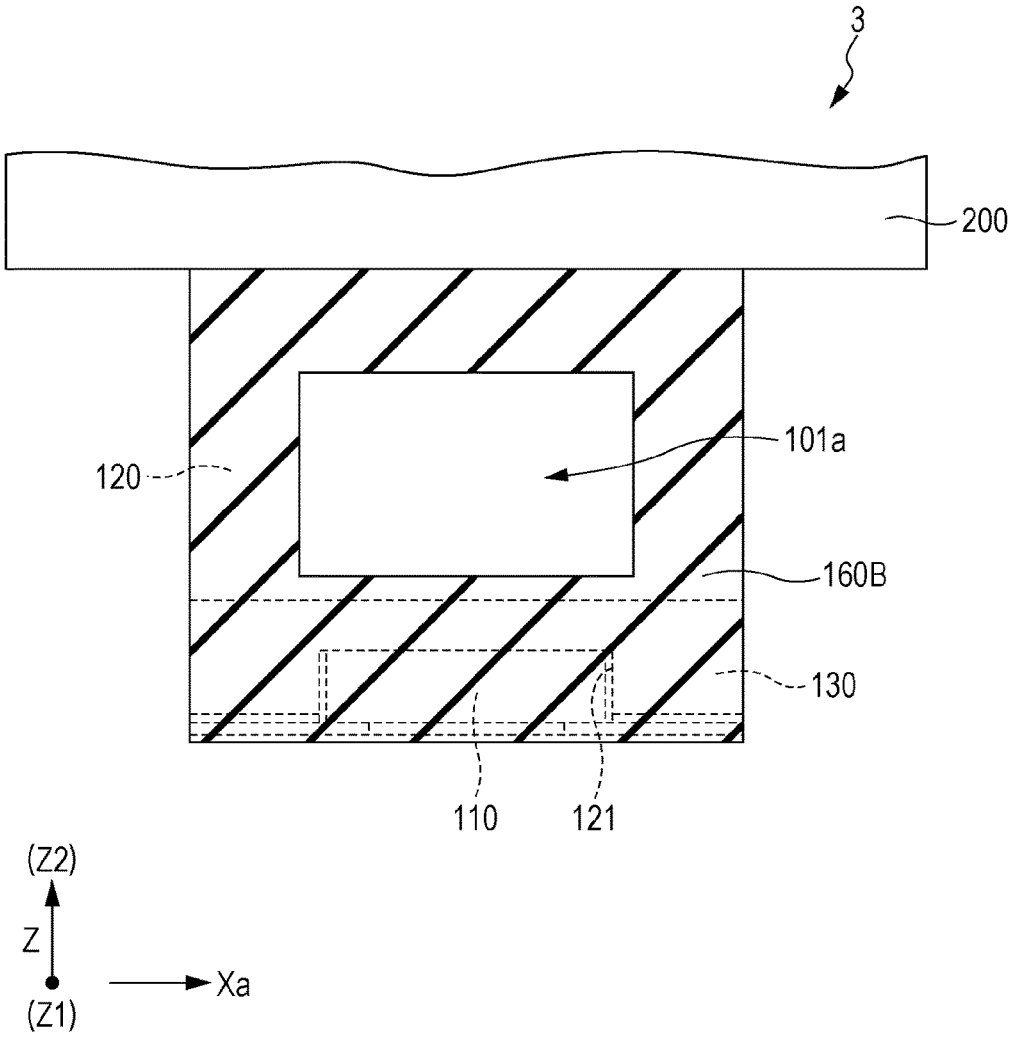
FIG. 16 is a cross-sectional view of main portions showing a modification of the recording head according to embodiment 2 of the invention.

Here, in the present embodiment, the elastic member 160A is provided in a so-called U shape along the opening on the Z1 side and the opening on both sides in the first direction X in the gap 101; however, the invention is not particularly limited thereto. Here, a modification of the elastic member is shown in FIG. 16. Here, FIG. 16 is a cross-sectional view showing a modification of the recording head according to embodiment 2.

As shown in FIG. 16, an elastic member 160B is provided in a so-called square shape continuously along the opening on the Z1 side of the gap 101, the openings on both sides in the first direction X, and the surface on the Z2 side which is held by the holder 200. Then, the space portion 101*a* in which the elastic member 160B is not provided is formed in the central portion of the gap 101. Even with the elastic member 160B, it is possible to suppress ink from entering the gap and it is possible to suppress the generation of foreign matter caused by the wiper 150 coming into contact therewith. In addition, by providing the space portion 101*a*, the elastic member 160B comes into contact with the side surface of the opening side of the head body 100 at a narrower area than the side surface which forms the gap 101 of the head bodies 100. Therefore, it is possible to suppress positional shifting or the like of the head body 100 by reducing the pressure which presses the head body 100 due to the elastic force of the elastic member 160B.

Here, regarding the elastic member 160B shown in FIG. 16, the area which is contact with the holder 200 on the Z2 side in the third direction Z is wide. Therefore, regarding the elastic member 160B, positional shifting is less easily generated in the gap 101.

Figure 17:
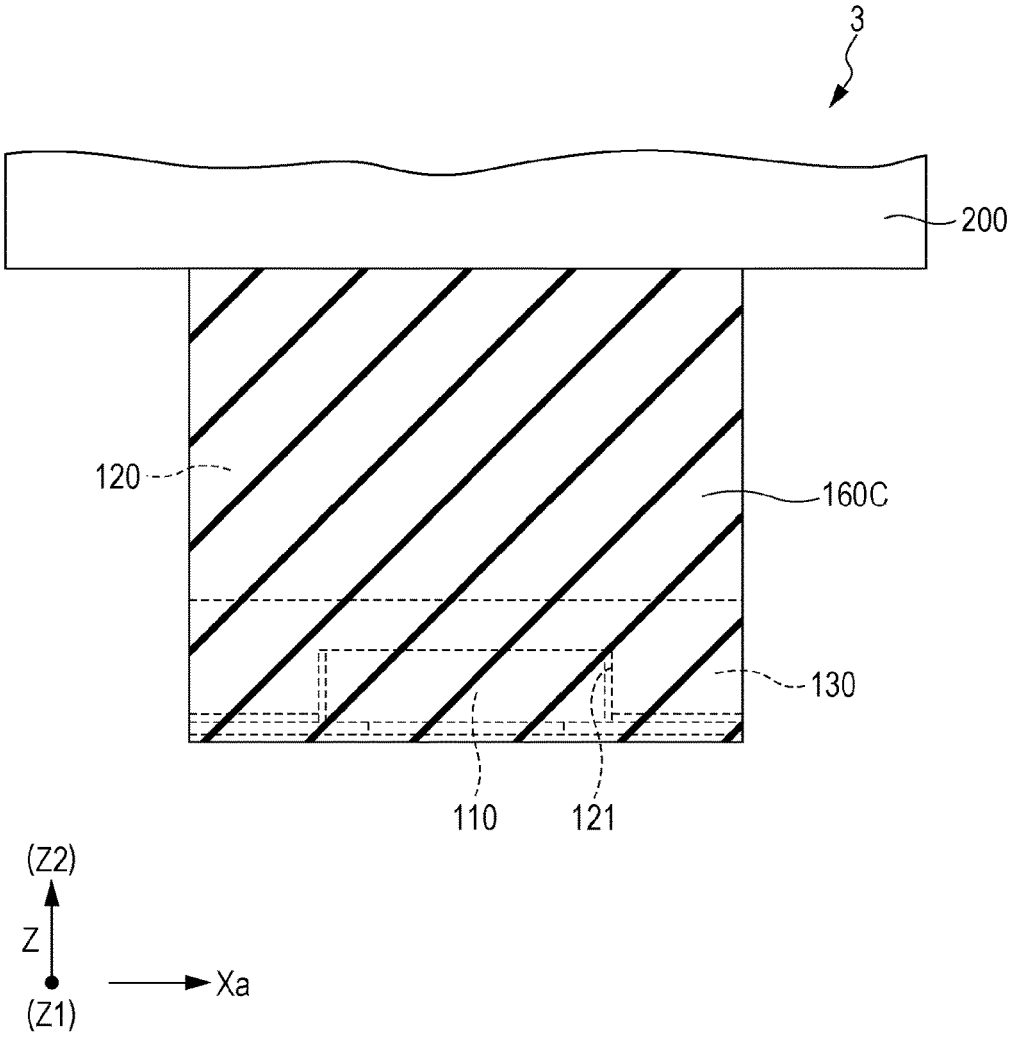
FIG. 17 is a cross-sectional view of main portions showing a modification of the recording head according to embodiment 2 of the invention.
Figure 18:
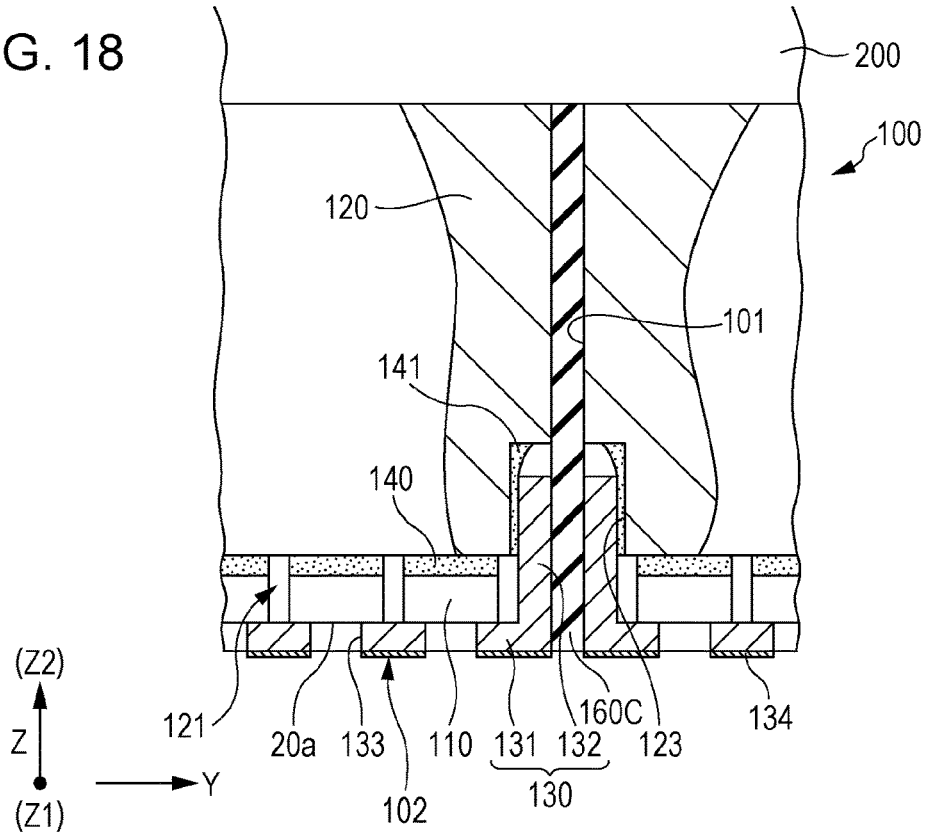
FIG. 18 is a cross-sectional view of main portions showing a modification of the recording head according to embodiment 2 of the invention.

Here, the elastic member is only provided in the opening portion of the gap 101 in the example described above; however, the invention is not particularly limited thereto and the elastic member 160 may be provided over the entire surface of the gap 101. The examples are shown in FIG. 17 and FIG. 18. Here, FIG. 17 and FIG. 18 are main portion cross-sectional views which show modifications of the recording head according to embodiment 2.

As shown in FIG. 17 and FIG. 18, an elastic member 160C is provided over the entire surface of the gap 101. That is, the elastic member 160C has substantially the same area as the side surface which forms the gap 101 of the head bodies 100. According to the elastic member 160C, it is possible to further suppress positional shifting or bending in the gap 101.

Embodiment 3

Figure 19:
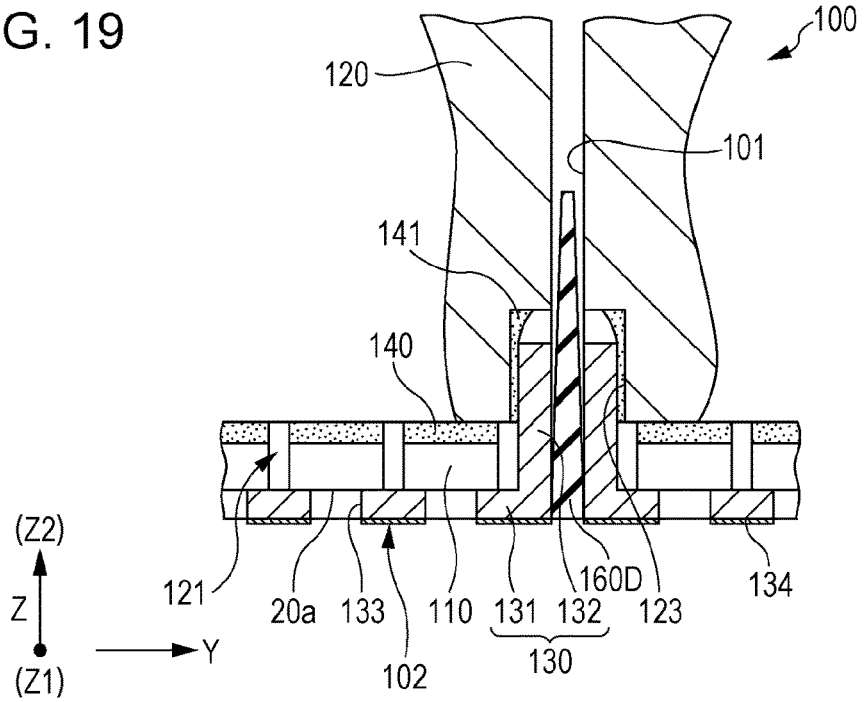
FIG. 19 is a cross-sectional view of main portions of a recording head according to embodiment 3 of the invention.

FIG. 19 is a main portion cross-sectional view of the recording head according to embodiment 3 of the invention. Here, the same reference numerals are given to the same members as the embodiment described above and overlapping description is omitted.

As shown in the diagram, in the present embodiment, an elastic member 160D is held in the gap 101 between the head bodies 100 which are adjacent in the second direction Y in a state of elastic deformation.

The elastic member 160D is provided along the opening on the wiping surface 102 side of the gap 101 in the same manner as embodiment 1.

In addition, the thickness of the elastic member 160D is thinner at the inside of the opening on the wiping surface 102 side than at the opening side.

Even with the elastic member 160D, it is possible to reliably block the opening on the wiping surface 102 side of the gap 101. In addition, making the thickness of the elastic member 160D thinner at the inside than at the opening makes it possible to reduce the pressure with which the elastic member 160D presses the side surface in the second direction Y of the head body 100 and to suppress positional shifting or the like of the head body 100.

Embodiment 4

Figure 20:
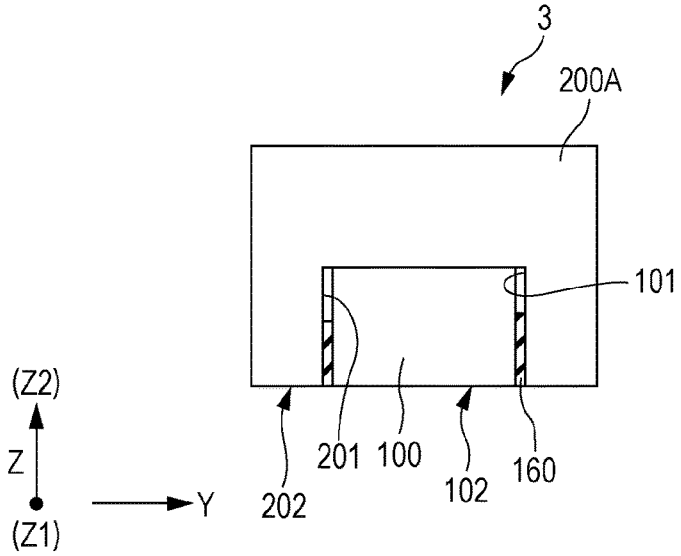
FIG. 20 is a cross-sectional view of main portions of a recording head according to embodiment 4 of the invention.

FIG. 20 is a main portion cross-sectional view of the recording head according to embodiment 4 of the invention. Here, the same reference numerals are given to the same members as the embodiment described above and overlapping description is omitted.

As shown in the diagram, the recording head 3 of the present embodiment is equipped with the head body 100 which discharges ink and a holder 200A.

The holder 200A has an accommodating portion 201 which has a concave shape which is able to accommodate the head body 100 on the surface on the Z1 side. Then, one head body 100 is held in the accommodating portion 201 of the holder 200A in a state of having the gap 101 with the inner wall surface of the accommodating portion 201 in the second direction Y.

In addition, the surface on the Z1 side of the holder 200A is provided facing the same direction as the wiping surface 102 of the head body 100 and the position is substantially the same in the third direction Z. Then, the surface on the Z1 side of the holder 200A is a wiping surface 202 which is wiped with the wiper 150.

That is, in the present embodiment, the wiping surface 102 of the head body 100 corresponds to the first wiping surface and the holder 200A which is lined up via the gap 101 in the head body 100 corresponds to the target wiping member. In addition, the wiping surface 202 of the holder 200A corresponds to the second wiping surface.

In the recording head 3, the elastic member 160 which blocks the openings on the wiping surfaces 102 and 202 sides is held in the gap 101 between the head body 100 and the holder 200A in a state of elastic deformation. Here, the elastic member 160 is the same as embodiment 1 described above. Naturally, the elastic member 160 is not particularly limited thereto and may be the elastic members 160A to 160D in the embodiments 2 and 3 described above.

By providing the elastic member 160 in the gap 101 between the holder 200A and the head body 100 in this manner, it is possible to suppress ink from entering the gap 101 when wiping the wiping surfaces 102 and 202 with the wiper 150. In addition, it is possible to suppress the generation of foreign matter caused by the wiper coming into contact with the elastic member 160.

Figure 21:
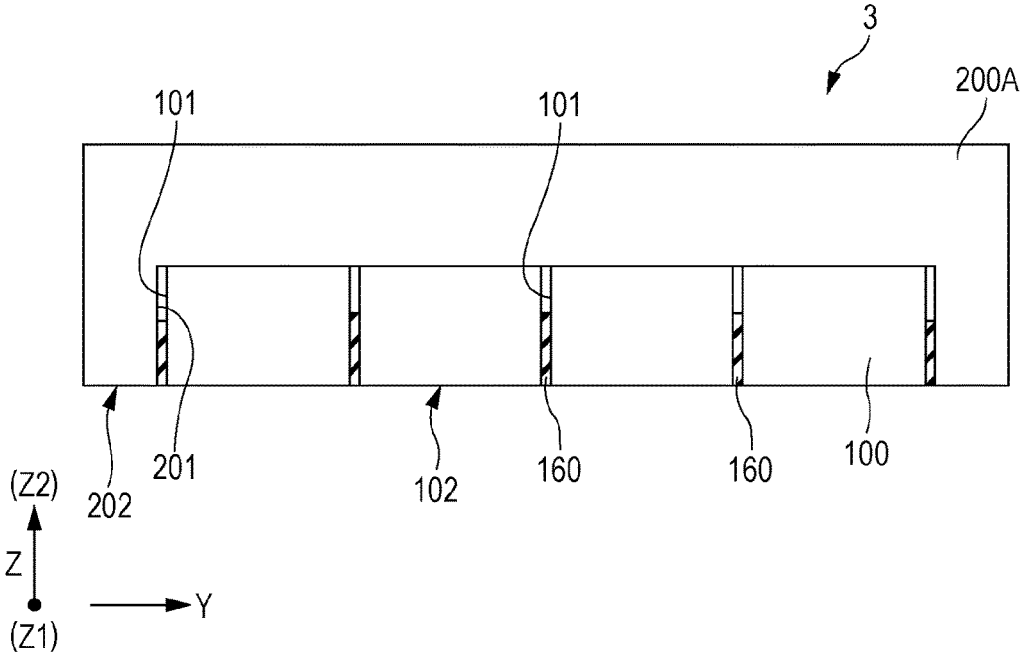
FIG. 21 is a cross-sectional view of main portions showing a modification of the recording head according to embodiment 4 of the invention.

Here, one head body 100 is held in the accommodating portion 201 of the holder 200A in the present embodiment; however, the invention is not particularly limited thereto and a plurality of the head bodies 100 may be held in the holder 200A in the same manner as embodiment 1 described above. The example is shown in FIG. 21. Here, FIG. 21 is a side surface view showing a modification of the recording head according to embodiment 4.

As shown in FIG. 21, four of the head bodies 100 are jointly provided via the gap 101 in the second direction Y in the accommodating portion 201 of the holder 200A. Then, in the same manner as embodiment 1 described above, the elastic member 160 is provided in the gap 101 between the adjacent head bodies 100. In addition, the elastic member 160 is also provided in the gap 101 between the head body 100 and the holder 200A. That is, in the example shown in FIG. 21, when the wiping surface 102 of one arbitrary head body 100 out of the plurality of the head bodies 100 is the first wiping surface, the head body 100 which is lined up via the gap 101 in the one arbitrary head body 100 corresponds to the target wiping member and the wiping surface 102 of the head body 100 corresponds to the second wiping surface. In addition, when the wiping surface 102 of the head body 100 which is provided at both ends in the second direction Y in the accommodating portion 201 is the first wiping surface, the holder 200A corresponds to the target wiping member and the wiping surface 202 of the holder 200A corresponds to the second wiping surface.

Embodiment 5

Figure 22:
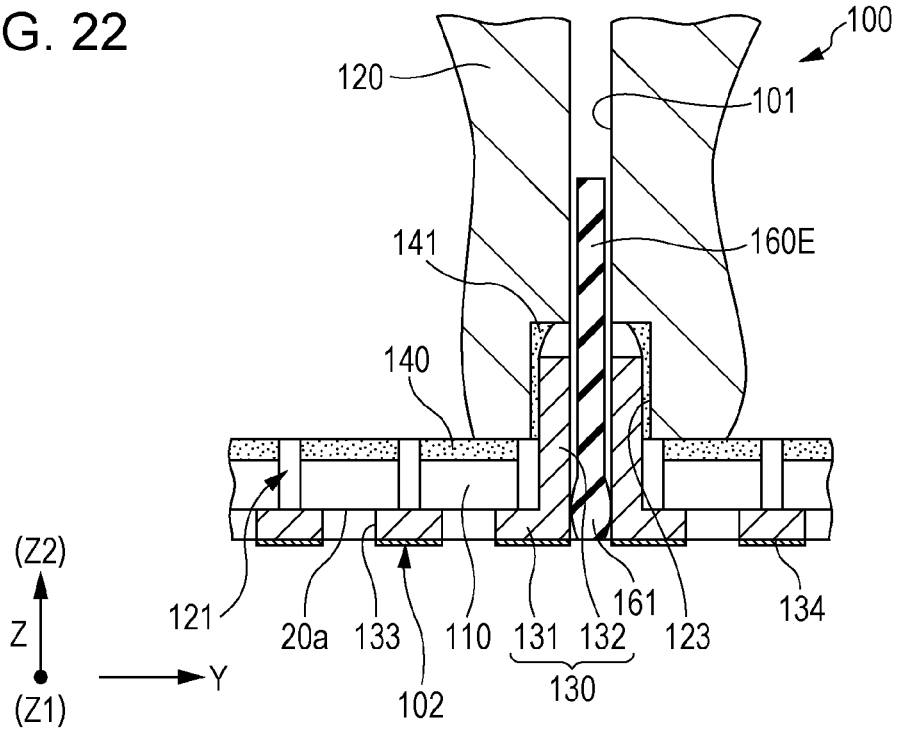
FIG. 22 is a cross-sectional view of main portions of a recording head according to embodiment 5 of the invention.

FIG. 22 is a main portion cross-sectional view of the recording head according to embodiment 5 of the invention. Here, the same reference numerals are given to the same members as the embodiment described above and overlapping description is omitted.

As shown in FIG. 22, an elastic member 160E is held in the gap 101 between the head bodies 100 which are adjacent to each other in a state of elastic deformation.

The elastic member 160E has a protrusion 161 which protrudes toward the head body 100. In the present embodiment, the protrusion 161 has a shape where the width in the third direction Z becomes smaller toward the protruding front end. In addition, the protrusion 161 is provided continuously along the opening on the wiping surface 102 side of the gap 101.

By providing the protrusion 161 in the elastic member 160E in this manner, it is possible to reduce the pressure which presses the head body 100 due to the elastic deformation of the elastic member 160E by reducing the area where the elastic member 160E and the head body 100 are in contact, and it is possible to suppress positional shifting of the head body 100.

Here, the number of the protrusions 161 is not particularly limited and for example, two or more may be provided. An example is shown in FIG. 23.

Figure 23:
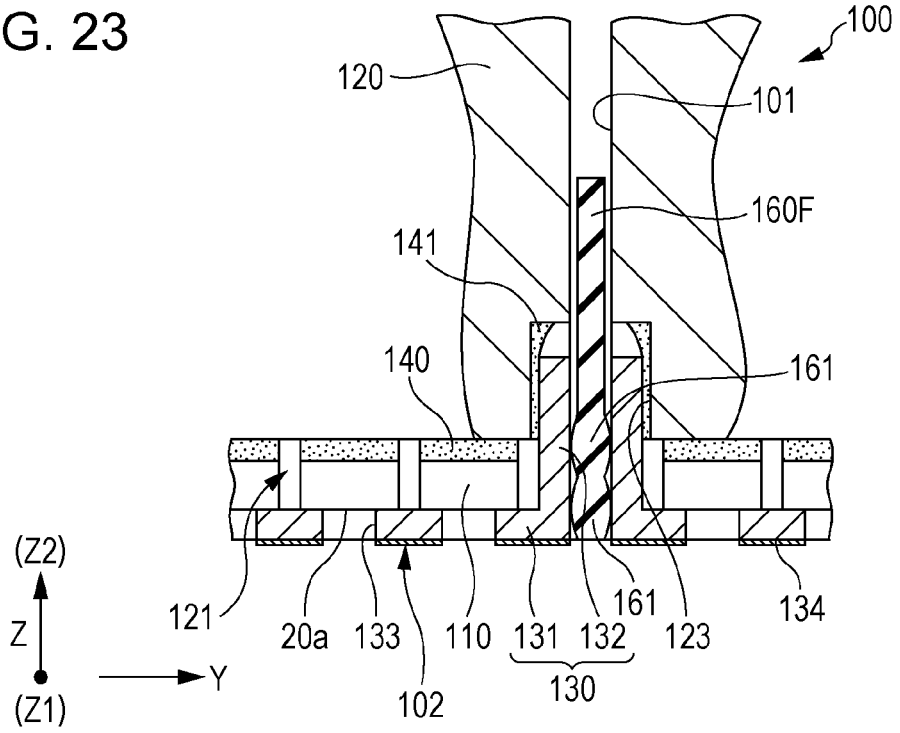
FIG. 23 is a cross-sectional view of main portions showing a modification of the recording head according to embodiment 5 of the invention.

As shown in FIG. 23, two of the protrusions 161 which protrude toward each of the head bodies 100 are provided in an elastic member 160F. Even with this configuration, it is possible to reduce the pressure which presses the head body 100 due to the elastic deformation of the elastic member 160F by reducing the area where the elastic member 160F and the head body 100 are in contact and it is possible to suppress positional shifting of the head body 100.

Embodiment 6

Figure 24:
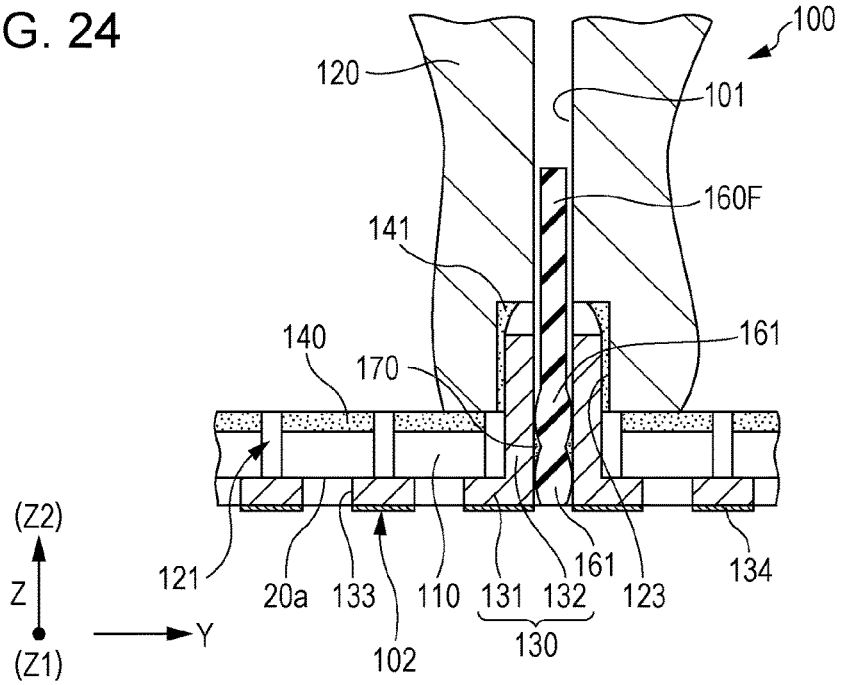
FIG. 24 is a cross-sectional view of main portions of a recording head according to embodiment 6 of the invention.

FIG. 24 is a main portion cross-sectional view of the recording head according to embodiment 6 of the invention. Here, the same reference numerals are given to the same members as the embodiment described above and overlapping description is omitted.

As shown in FIG. 24, in the present embodiment, in the elastic member 160F which is the same as in embodiment 5, a portion other than the opening of the gap 101 is adhered using an adhesive agent 170.

In detail, the adhesive agent 170 is provided between the two protrusions 161 and the side surface of the head body 100.

It is possible to suppress positional shifting of the elastic member 160F by adhering the elastic member 160F with the adhesive agent 170 in the portion other than the opening of the gap 101 in this manner.

In addition, since the adhesive agent 170 is provided in a portion other than the opening of the gap 101, it is possible to suppress the adhesive agent 170 from becoming foreign matter due to the erosion of ink or becoming foreign matter by coming into contact with the wiper 150. Here, when the adhesive agent 170 is provided on the opening portion side of the gap 101, ink comes into contact with the adhesive agent 170 and is eroded and foreign matter is generated. In addition, foreign matter is generated by the adhesive agent 170 coming into contact with the wiper 150.

Here, the elastic member 160F is adhered to the head bodies 100 on both sides in the second direction Y with the adhesive agent 170 in the present embodiment but may be only adhered, for example, to the head body 100 on one side without being particularly limited thereto.

Even in a case of adhering the elastic member 160F with the head bodies 100 in this manner, it is possible to say that the elastic member 160F is held in the gap 101 in a state of elastic deformation. In other words, the elastic member 160F and the head body 100 are directly in contact in the protrusion 161 and it is possible to say that there is elastically deformation when the width of the front ends of the protrusion 161 which is provided on both surfaces of the elastic member 160F is wider than the gap 101.

In addition, in a case of adhering the elastic member 160F with the head body 100, it is also possible to manufacture the recording head 3 by a different manufacturing method from embodiment 1 described above. Here, description will be given of the manufacturing method of the present embodiment with reference to FIG. 25 to FIG. 27. Here, FIG. 25 to FIG. 27 are side surface views which show the manufacturing method for the recording head.

Figure 25:
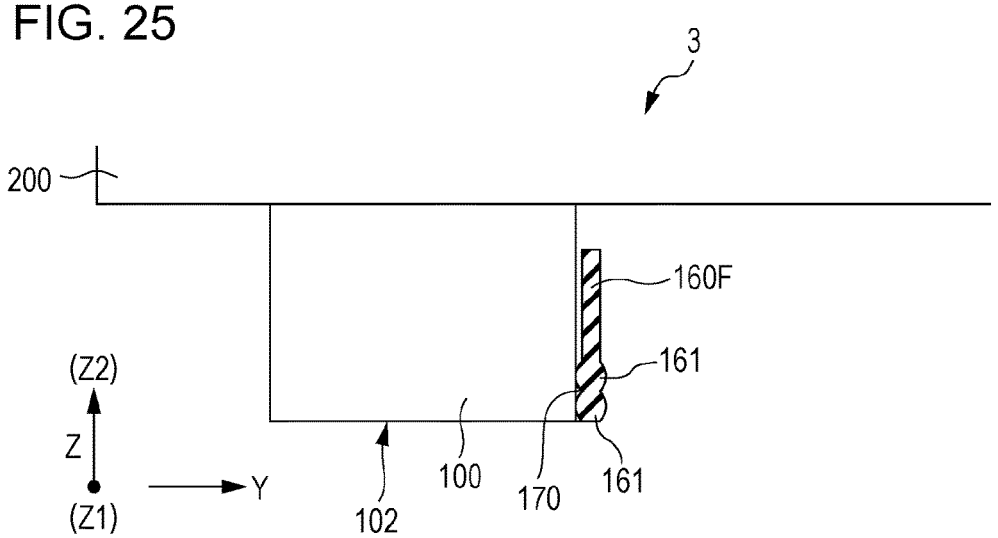
FIG. 25 is a side surface view showing method for manufacturing the recording head according to embodiment 6 of the invention.

Firstly, as shown in FIG. 25, the elastic member 160F is adhered to the side surface in the second direction Y of the first head body 100 with the adhesive agent 170. The adhesion of the elastic member 160F with the head body 100 may be performed before the head body 100 is fixed to the holder 200 and may be performed after the head body 100 is fixed to the holder 200.

Figure 26:
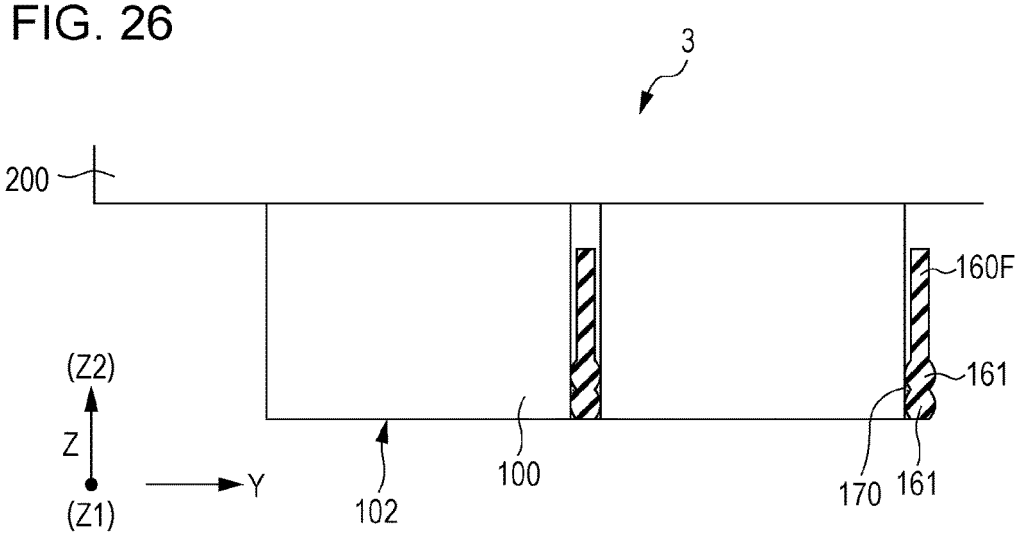
FIG. 26 is a side surface view showing a method for manufacturing the recording head according to embodiment 6 of the invention.
Figure 27:
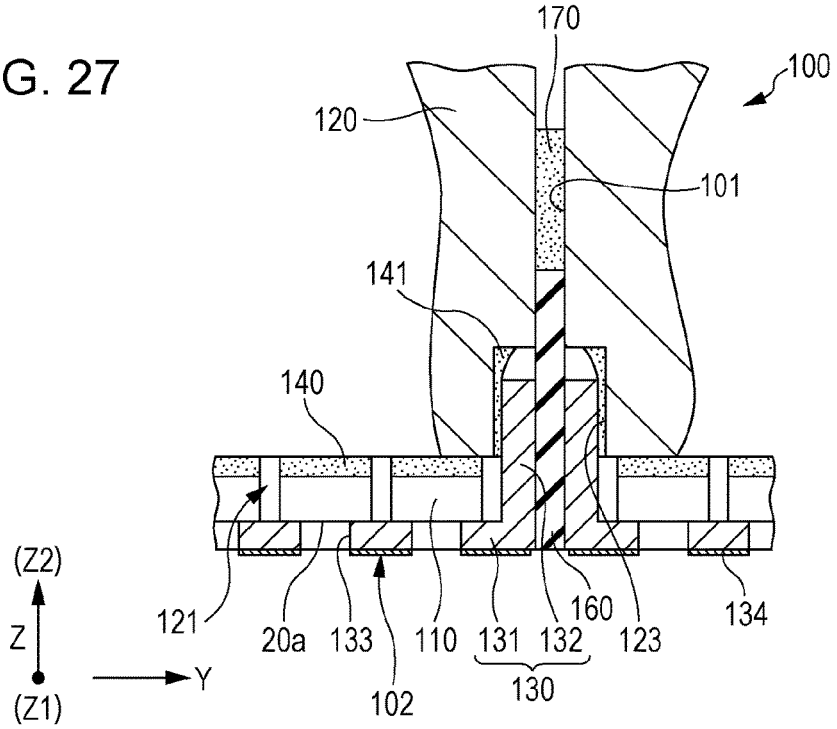
FIG. 27 is a cross-sectional view showing a modification of the recording head according to embodiment 6 of the invention.

Next, as shown in FIG. 26, the second head body 100 is fixed to the holder 200 after relative alignment thereof with respect to the first head body 100. Due to this, it is possible to hold the elastic member 160F in the gap 101 between the two head bodies 100 in a state of elastic deformation. Here, the elastic member 160F is adhered to the second head body 100 beforehand or after fixing to the holder 200. After that, it is possible to set the recording head 3 by fixing with the holder 200 while also aligning the other head bodies 100 after the third in the same manner. Here, when the elastic member 160F between the two head bodies 100 and the second head body 100 are adhered with the adhesive agent 170 after fixing the second head body 100 with the holder 200, it is possible to set the recording head 3 shown in FIG. 24 described above. Naturally, the adhesion is not essential and the elastic member 160F which is adhered to the first head body 100 and the second head body 100 need not be adhered.

By fixing the next head body 100 with the holder 200 after adhering the elastic member 160F with the head body 100 in this manner, it is possible to easily and precisely perform the alignment of the head body 100 and the elastic member 160F. Therefore, it is possible to suppress defects such as the elastic member 160F protruding from the wiping surface 102.

Here, the elastic member 160F is adhered to the head body 100 in the present embodiment; however, the invention is not particularly limited thereto and the elastic members 160 to 160E in the embodiments 1 to 5 described above may be adhered to the head bodies 100. Even in this case, when the adhesive agent which adheres the head bodies 100 and the elastic members 160 to 160E is provided in a portion other than the opening on the wiping surface 102 side of the gap 101, it is possible to suppress the adhesive agent from becoming foreign matter. In addition, for example, as shown in FIG. 27, in a case where the elastic member 160 of embodiment 1 is provided in the gap 101, the head bodies 100 may be adhered to each other by providing the adhesive agent 170 in the space between the elastic member 160 of the gap 101 and the holder 200. It is possible to produce the adhesive agent 170 by filling the adhesive agent 170 in the space portion after manufacturing the recording head 3 by the same manufacturing method as embodiment 1 described above. It is possible to suppress relative positional shifting of the head bodies 100 by adhering the head bodies 100 with each other with the adhesive agent 170 in this manner. Here, the adhesive agent 170 adheres the elastic member 160 and the head bodies 100 in the present embodiment; however, it is possible to suppress positional shifting of the head bodies 100 even when the adhesive agent 170 does not adhere the elastic member 160 and the head bodies 100. In the present embodiment, as shown in FIG. 27, it is also possible to suppress positional shifting of the elastic member 160 adhering the head bodies 100 and the elastic member 160 with the adhesive agent 170.

Other Embodiments

Description was given above of each of the embodiments of the invention; however, the basic configuration of the invention is not limited to the description above.

For example, in embodiment 1 described above, the head chip 110 is provided with a plurality of members such as the flow path-forming substrate 10, the interconnecting board 15, the nozzle plate 20, the protective substrate 30, the compliance substrate 45, and the case 40; however, it is sufficient if, in order to eject a liquid from the nozzle openings 21 which are provided in the liquid ejecting surface 20*a*, at least a pressure generating means which generates pressure in the pressure generating chambers 12 which are interconnected with the nozzle openings 21 and a plurality of the pressure generating chambers 12 which are provided with the pressure generating means and which are lined up along a predetermined direction, are provided. That is, the Z1 side of the holding member 120 is adhered to the Z2 side of the head chip 110 and the head chip 110 laminates the case 40 furthest to the Z2 side in embodiment 1 described above; however, it is not necessary for the head chip 110 to be adhered to the holding member 120 via the case 40 and the head chip 110 may be adhered to the holding member 120 without the case 40.

In addition, the cover 130 which is a fixing board which is provided on the liquid ejecting surface 20*a* side of the head body 100 and the nozzle plate 20 in which the nozzle openings 21 of the head chip 110 are provided are separate in each of the embodiments described above; however, the invention is not particularly limited thereto and the nozzle plate 20 may only be provided without providing the cover 130. In this case, for example, the bending portion 132 may be provided by extending the nozzle plate 20 to the outside of the head chip 110 and bending the extended end in the Z2 direction. In addition, another member which is different from the nozzle plate 20 may be provided further to the Z1 side than the fixing board on the liquid ejecting surface 20*a* of the head body 100. In any case, the nozzle openings 21 need not be formed on the wiping surface as long as there is the wiping surface which is wiped by the wiper and the configuration of the head body 100 is not particularly limited.

In addition, the lining up direction of the plurality of the head bodies 100 which are held in the holder 200 is the second direction Y which is an orthogonal direction with respect to the first direction X which is the transport direction of the recording sheet S in each of the embodiments described above; however, the invention is not particularly limited and the recording head where the head bodies 100 are lined up in a longitudinal direction of the holder 200 may be arranged such that the lining up direction of the plurality of the head bodies 100 is an angle which intersects with respect to the first direction X which is the transport direction of the recording sheet S, that is, an angle smaller than 90 degrees with respect to the first direction X. At this time, even when the nozzle row is provided in a direction orthogonal to the longitudinal direction of the holder 200 in the in-plane direction of the liquid ejecting surface 20*a*, it is possible to arrange the nozzle row which inclines with respect to the first direction X which is a transport direction by inclining the entire recording head.

Figure 28:
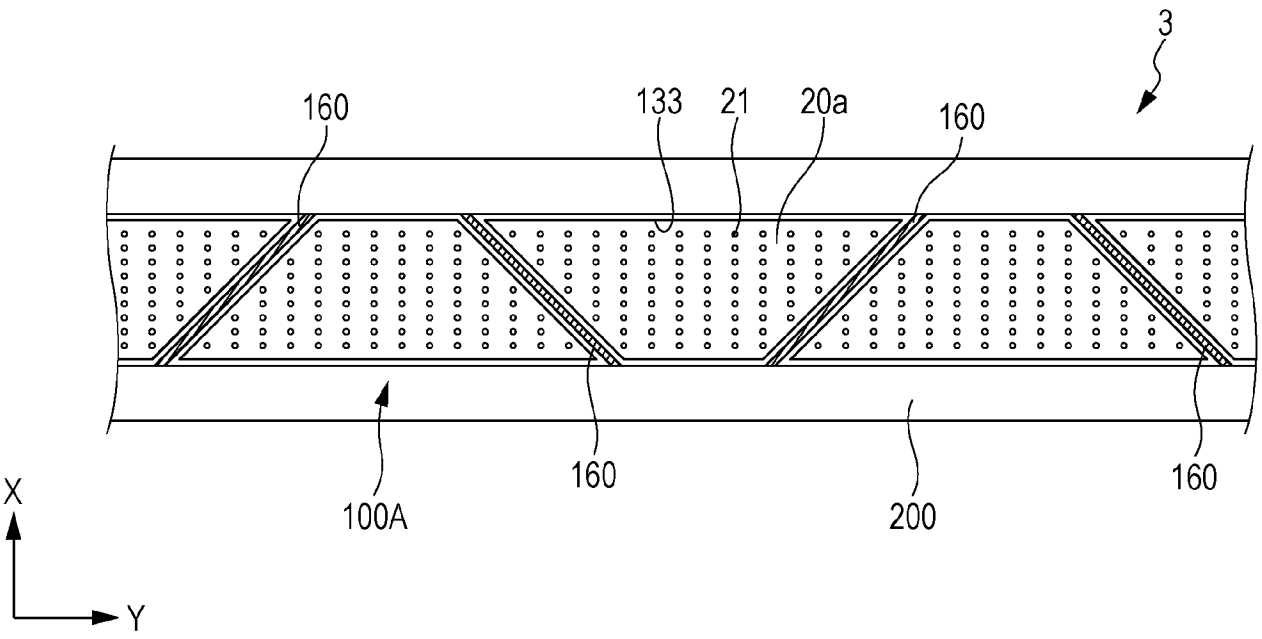
FIG. 28 is a plan view of a recording head according to another embodiment of the invention.

Furthermore, the fourth direction Xa which is the lining up direction of the nozzle openings 21 of the head chip 110 is a direction which inclines with respect to the second direction Y which is orthogonal to the first direction X which is the transport direction in each of the embodiments described above; however, the fourth direction Xa which is the lining up direction of the nozzle openings 21 may be the same direction as the first direction X which is the transport direction and the fourth direction Xa which is the lining up direction of the nozzle openings 21 may also be the same direction as the second direction Y. Furthermore, the nozzle openings 21 are not limited to ones which are provided in a row form and the nozzle openings 21 may be arranged in a matrix form. Furthermore, the holding member 120 is substantially a parallelogram when viewed in plan view from the third direction Z which is orthogonal to the liquid ejecting surface 20*a* in embodiment 1 described above but may be a rectangle, a trapezoid, a polygon, or the like without being limited thereto. Here, an example is shown in FIG. 28. Here, FIG. 28 is a plan view from the liquid ejecting surface side of the ink jet recording head which is an example of the liquid ejecting head according to another embodiment of the invention.

As shown in FIG. 28, a head body 100A has a trapezium when viewed in plan view from the liquid ejecting surface 20*a*. In addition, a plurality of the head bodies 100A are lined up in the second direction Y and fixed to the holder 200 and the head bodies 100A which are lined up in the second direction Y are arranged rotated at 180 degrees in the in-plane direction of the liquid ejecting surface 20*a* every other one.

The nozzle openings 21 are arranged in a matrix form on the liquid ejecting surface 20*a* in the head bodies 100A. Even with this configuration, it is possible to suppress ink from entering the gap 101 and generation of foreign matter when carrying out wiping by blocking the openings on the wiping surfaces 102 and 202 sides of the gap 101 with the elastic members 160 to 160F in the same manner as each of the embodiments described above.

Furthermore, a so-called line type recording apparatus which performs printing with the recording head 3 fixed to the apparatus body 2 and only transports the recording sheet S is exemplified as the ink jet recording apparatus 1 in embodiment 1 described above; however, the invention is not particularly limited thereto and it is also possible to apply the invention to a so-called serial type recording apparatus which performs printing while moving the recording head 3 in a direction which intersects with a transport direction by mounting the recording head 3 on a carriage which moves in a direction which intersects with the first direction X which is the transport direction of the recording sheet S, for example, in the second direction Y. In addition, the invention is not limited to the configuration which transports the recording sheet S with respect to the recording head 3 and printing may be performed by a configuration which moves the recording head 3 with respect to the recording sheet S and the recording sheet S may be transported relatively to the recording head 3.

In addition, in embodiment 1 described above, the pressure generating means which generates pressure change in the pressure generating chamber 12 is illustrated using the piezoelectric actuator 300 which is laminated in the third direction Z; however, the piezoelectric actuator 300 may be, for example, a thin film type which is formed by film-forming or a lithography method, a thick film type which is formed by a method such as sticking a green sheet, or the like. In addition, regarding the piezoelectric actuator 300, it is possible to use a longitudinal vibration type piezoelectric actuator in which piezoelectric material and electrode forming material are alternatively laminated and which expands and contracts in an axis direction. In addition, as the pressure generating means, it is possible to use a pressure generating means which ejects liquid droplets from the nozzle openings 21 using bubbles which are generated by the heat of heat elements by arranging the heat elements in the pressure generating chamber, a so-called electrostatic type actuator which ejects liquid droplets from the nozzle openings 21 by generating static electricity between the vibration board and the electrode and changing the shape of the vibration board using the electrostatic force, and the like.

Furthermore, the invention widely targets general liquid ejecting heads and, for example, is also able to be applied to recording heads such as various types of ink jet recording heads which are used for an image recording apparatus such as printers, coloring material ejecting heads which are used for manufacturing color filters such as liquid crystal displays, organic EL displays, electrode material ejecting heads which are used for forming electrodes such as field emission displays (FED), bio-organic matter ejecting heads which are used for manufacturing bio chips, and the like.

The entire disclosure of Japanese Patent Application No.: 2015-214959, filed Oct. 30, 2015 is incorporated by reference herein.

What is claimed is:

1. A method for manufacturing a liquid ejecting head comprising:

lining up a head body and a target wiping member with a gap such that a first wiping surface of the head body and a second wiping surface of the target wiping member face in a same direction, the first wiping surface and the second wiping surface being configured to be wiped by a wiper, longitudinally stretching and inserting an elastic member in the gap between the head body and the target wiping member, and contracting the elastic member using elastic force of the elastic member to block an opening of the gap.

2. The method as claimed in claim 1, wherein the elastic member has a protrusion portion that blocks the opening of the gap and a planar portion extending from the protrusion portion.

3. The method as claimed in claim 1, wherein the elastic member is thinner at an inside of an opening of the gap compared to at an opening side of the gap.

4. The method as claimed in claim 1, wherein a liquid-repellent film is formed on the first wiping surface of the head body, and the liquid-repellent film is removed in a portion which is in contact with the elastic member of the head body.

5. The method as claimed in claim 1, wherein the target wiping member is configured as a holder which holds the head body.

6. The method as claimed in claim 1, wherein the elastic member has a shape following an opening of the gap, and the elastic member is in contact with the head body at a narrower area than a side surface which forms the gap of the head body.

7. The method as claimed in claim 1, wherein the head body is held an opposite surface side to the first wiping surface of the head body by a holder, the gap is provided from the first wiping surface of the head body to a surface side which is held by the holder, and the elastic member is provided at a height which reaches a surface which holds the head body of the holder from the opening of the first wiping surface side of the gap.

8. A method for manufacturing a liquid ejecting head comprising:

bonding an elastic member to one of a head body and a target wiping member, and following bonding the elastic member, lining up the head body and the target wiping member via the elastic member to block an opening of a gap between the head body and the target wiping member, each of the head body and the target wiping member having a surface configured to be wiped by a wiper.

9. The method as claimed in claim 8, wherein the elastic member has a protrusion portion and a planar portion extending from the protrusion portion.

10. The method as claimed in claim 8, wherein the elastic member and the head body are adhered using an adhesive agent which is provided in a portion other than an opening of the gap.

11. The method as claimed in claim 8, wherein the elastic member is thinner at an inside of an opening of the gap compared to at an opening side of the gap.

12. The method as claimed in claim 8, wherein a liquid-repellent film is formed on the first wiping surface of the head body, and the liquid-repellent film is removed in a portion which is in contact with the elastic member of the head body.

13. The method as claimed in claim 8, wherein the target wiping member is configured as a holder which holds the head body.

14. The method as claimed in claim 8, wherein the elastic member has a shape following an opening of the gap, and the elastic member is in contact with the head body at a narrower area than a side surface which forms the gap of the head body.

15. The method as claimed in claim 8, wherein the head body is held an opposite surface side to the first wiping surface of the head body by a holder, the gap is provided from the first wiping surface of the head body to a surface side which is held by the holder, and the elastic member is provided at a height which reaches a surface which holds the head body of the holder from the opening of the first wiping surface side of the gap.

* * * * *